US011554291B2

(12) United States Patent
Assad et al.

(10) Patent No.: US 11,554,291 B2
(45) Date of Patent: Jan. 17, 2023

(54) HINGED ARM MUSCLE EXERCISE DEVICE

(71) Applicant: HCD Agency LLC, Los Angeles, CA (US)

(72) Inventors: Hanna Elisabeth Assad, Los Angeles, CA (US); David G. Vogt, Jr., Salt Lake City, UT (US); Henrik Stranne, Ekerö (SE)

(73) Assignee: HCD AGENCY LLC, Los Angeles, CA (US)

( * ) Notice: Subject to any disclaimer, the term of this patent is extended or adjusted under 35 U.S.C. 154(b) by 208 days.

(21) Appl. No.: 16/518,793

(22) Filed: Jul. 22, 2019

(65) Prior Publication Data

US 2019/0336823 A1 Nov. 7, 2019

Related U.S. Application Data

(63) Continuation-in-part of application No. 14/958,169, filed on Dec. 3, 2015, now Pat. No. 10,357,684.

(51) Int. Cl.

| | |
|---|---|
| ***A63B 23/20*** | (2006.01) |
| ***A63B 21/045*** | (2006.01) |
| ***A63B 21/00*** | (2006.01) |
| ***A63B 21/02*** | (2006.01) |

(Continued)

(52) U.S. Cl.

CPC ..... *A63B 23/20* (2013.01); *A63B 21/00043* (2013.01); *A63B 21/028* (2013.01); *A63B 21/045* (2013.01); *A63B 21/00061* (2013.01); *A63B 21/00069* (2013.01); *A63B 21/026* (2013.01); *A63B 21/04* (2013.01); *A63B 21/05* (2013.01); *A63B 21/4047* (2015.10); *A63B 2209/00* (2013.01); *A63B 2220/51* (2013.01); *A63B 2220/833* (2013.01)

(58) Field of Classification Search

CPC ..... A63B 21/028; A63B 21/05; A63B 23/20; A63B 23/16; A63B 21/4019

See application file for complete search history.

(56) References Cited

U.S. PATENT DOCUMENTS 630,741 A * 8/1899 Robinson ..... A63B 23/16 482/50
2,806,699 A * 9/1957 Spooner ..... A63B 21/4047 482/126
3,036,389 A 5/1962 Wesch (Continued)

FOREIGN PATENT DOCUMENTS

DE 19620945 A1 11/1997

OTHER PUBLICATIONS

U.S. Appl. No. 14/121,186, filed Aug. 11, 2014, Henry C. Keck.

(Continued)

*Primary Examiner* — Nyca T Nguyen
(74) *Attorney, Agent, or Firm* — Workman Nydegger

(57) ABSTRACT

In one example, a muscle exercise device includes a first arm, a second arm rotatably connected to the first arm, and the second arm and first arm configured to cooperatively define a recess. The muscle exercise device also includes a resistance element configured to reside in the recess and be compressed between the first arm and the second arm, and a wireless transmitter disposed in either the first arm or the second arm, wherein the wireless transmitter is responsive to communications from an app residing on a user device.

23 Claims, 28 Drawing Sheets

(51) Int. Cl.
*A63B 21/04* (2006.01)
*A63B 21/05* (2006.01)

(56) References Cited

U.S. PATENT DOCUMENTS 4,262,898 A * 4/1981 Lee ..... A63B 21/0455 235/117 A
4,332,380 A 6/1982 Cardin
D281,802 S 12/1985 Gordon
4,572,503 A * 2/1986 Myung Ho ..... A63B 5/20 482/49
4,729,560 A 3/1988 Cho
4,869,492 A * 9/1989 Joutras ..... A63B 5/20 482/44
4,943,047 A * 7/1990 Noble ..... A63B 23/16 482/3
5,072,927 A * 12/1991 Santos ..... A63B 21/045 482/8
5,222,926 A 6/1993 Eggen
5,267,929 A 12/1993 Chen
5,360,385 A * 11/1994 Wang ..... A63B 23/16 482/126
5,380,259 A 1/1995 Robertson
D358,857 S 5/1995 Yang
5,529,551 A 6/1996 Chin
5,554,092 A 9/1996 Harpstead
D379,104 S 5/1997 Beard
5,674,164 A 10/1997 Kravitz
5,752,896 A 5/1998 White
5,833,580 A 11/1998 Chiu
5,865,715 A * 2/1999 Wallick ..... A63B 23/20 482/124
D408,062 S 4/1999 Beard
6,053,851 A * 4/2000 Tu ..... A63B 21/0004 482/121
6,063,006 A 5/2000 Chiu
D428,631 S 7/2000 Stein
6,258,015 B1 * 7/2001 Blackford ..... A63B 21/023 482/121
D446,561 S 8/2001 Beard
D446,857 S 8/2001 Stein
D447,234 S 8/2001 Stein
D447,235 S 8/2001 Stein
D460,505 S 7/2002 Yang
6,786,849 B1 9/2004 Faulconer
6,881,177 B2 4/2005 An
D505,169 S 5/2005 Kuo
7,001,315 B1 2/2006 Diodati
D521,086 S 5/2006 Faulconer
D561,850 S 2/2008 Yang
D626,188 S 10/2010 Bisson
7,824,311 B1 * 11/2010 Hsu ..... A63B 21/023 482/49
D634,796 S 3/2011 Batiste
7,955,237 B2 6/2011 Bisson
D654,126 S 2/2012 Eckermann
8,118,726 B1 * 2/2012 Blackford ..... A63B 23/20 600/29
8,133,158 B2 3/2012 An
D671,179 S 11/2012 Chang
8,376,912 B1 2/2013 Dedvukaj
8,556,786 B2 10/2013 Chen
9,149,675 B2 10/2015 Kubik
D747,167 S 1/2016 Harkin
9,364,711 B1 * 6/2016 Keck ..... A63B 21/02
9,776,040 B2 * 10/2017 Sedic ..... A63B 24/0062
D810,848 S 2/2018 Claesson
9,925,027 B1 * 3/2018 Blackford ..... A63B 21/0421
D831,763 S * 10/2018 Assad ..... D21/692
10,159,867 B2 * 12/2018 Hao ..... A63B 23/03508
2002/0147082 A1 * 10/2002 Harding-Randle .... A63B 23/20 482/128
2003/0036464 A1 * 2/2003 Zavilevich ..... A63B 23/20 482/92
2003/0148864 A1 * 8/2003 Blackford ..... A63B 23/20 482/124
2006/0036188 A1 * 2/2006 Hoffman ..... A63B 23/20 600/591
2006/0166797 A1 7/2006 Hamer
2007/0037665 A1 * 2/2007 Robbins ..... A63B 21/0004 482/11
2007/0060448 A1 3/2007 Silagy
2007/0167288 A1 * 7/2007 Lin ..... A63B 23/16 482/49
2008/0103026 A1 * 5/2008 An ..... A63B 21/023 482/49
2009/0239721 A1 9/2009 Bisson
2010/0004102 A1 * 1/2010 Harding-Randle .. A63B 21/026 482/124
2010/0093506 A1 4/2010 Aigner
2010/0248918 A1 9/2010 Nakamura
2011/0136634 A1 6/2011 Batiste
2013/0324380 A1 * 12/2013 Horsley ..... A63B 21/02 482/131
2014/0113771 A1 * 4/2014 Kubik ..... A63B 23/032 482/11
2014/0155225 A1 * 6/2014 Sedic ..... A61N 1/36007 482/9
2015/0126341 A1 * 5/2015 Philip ..... A63B 21/026 482/121
2015/0196802 A1 * 7/2015 Siegel ..... A63B 21/0023 482/8
2016/0144228 A1 * 5/2016 Jung ..... A63B 23/03508 482/8
2016/0166466 A1 * 6/2016 Topolev ..... A61H 19/44 601/46
2016/0279469 A1 9/2016 Rose
2016/0346610 A1 * 12/2016 Iglesias ..... A61B 5/1107
2017/0239516 A1 * 8/2017 Lee ..... A63B 21/026
2018/0264317 A1 * 9/2018 Yuan ..... A63B 23/20
2019/0160332 A1 * 5/2019 Beer ..... A61B 5/227
2019/0336823 A1 * 11/2019 Assad ..... A63B 21/00043
2020/0368577 A1 * 11/2020 An ..... A63B 21/0004
2021/0000674 A1 * 1/2021 Ramalho Da Fonseca ..... A61B 17/025

OTHER PUBLICATIONS

U.S. Appl. No. 14/958,169, filed Dec. 3, 2015, Hanna Elisabeth Claesson.
U.S. Appl. No. 29/572,397, filed Jul. 27, 2016, Hanna Elisabeth Claesson.
U.S. Appl. No. 29/637,069, filed Feb. 13, 2018, Hanna Elisabeth Assad.
https://kegelmaster.com/, Kegelmaster 2000 Kegel Exercise Device Official Company Website—Kegelmaster 2000, Copyright 2010-2016 Kegelmaster.com.
http://www.perifit.fr/, Copyright 2016 Perifit.
https://www.elvie.com/, 2014-2017 Chiaro.
https://www.minnalife.com/products/kgoal, 2016 Minna Life Inc.
https://www.intimina.com/en/kegelsmart, Intimina 2017.
EP Search Report and Opinion of EP Application 16202060.6 dated Mar. 10, 2017.
EP Notice of Intention ot Grant of EP Application 16202060.6 dated Mar. 3, 2018.
U.S. Appl. No. 14/121,186, Aug. 26, 2015, Office Action.
U.S. Appl. No. 14/121,186, Feb. 16, 2016, Notice of Allowance.
U.S. Appl. No. 14/958,169, Oct. 20, 2016, Office Action.
U.S. Appl. No. 14/958,169, May 8, 2017, Final Office Action.
U.S. Appl. No. 29/572,397, Dec. 18, 2017, Notice of Allowance.
U.S. Appl. No. 29/637,069, Jun. 6, 2018, Notice of Allowance.
U.S. Appl. No. 14/958,169, Jun. 19, 2018, Office Action.
U.S. Appl. No. 14/958,169, Mar. 12, 2019, Notice of Allowance.

* cited by examiner 10
13
13c
13b
14
18a
18
18b
22
26
26a
28

HINGED ARM MUSCLE EXERCISE DEVICE

RELATED APPLICATIONS

This application is a continuation-in-part (CIP) of U.S. patent application Ser. No. 14/958,169, entitled HINGED ARM MUSCLE EXERCISE DEVICE, and filed Dec. 3, 2015. All of the aforementioned applications are incorporated herein in their respective entireties by this reference.

FIELD OF THE INVENTION

Embodiments of the present invention generally concern devices that can be used to exercise various muscle groups. More particularly, at least some embodiments of the invention relate to devices for use by women to exercise pelvic muscles and/or other muscle groups to improve conditioning and strength of those muscles for birthing, bladder control, and any other processes that may utilize the exercised muscles and muscle groups.

BACKGROUND

Pregnant and post-partum women can experience a variety of problems that are unique to their anatomy and condition. At least some of these problems concern the lack of adequate conditioning of various muscle groups, such as the pelvic muscle group for example, that may be involved in the birthing process, and other processes that may be impacted by pregnancy and/or post-partum conditions.

Attempts have been made to address these problems with various types of exercises and exercise devices. However, such exercises and devices have not proven to be particularly effective. For example, pregnant and post-partum women are often advised by medical professionals to perform so-called kegel exercises to exercise and strengthen the muscle groups involved in control of the vagina, urethra and/or other portions of the body. However, it can be difficult for the woman to perceive any benefit or improvement as a result of having performed these exercises, and it can also be difficult to ascertain that the exercises are being properly performed.

Moreover, some exercise devices are problematic in that they are mechanically complex and require a relatively large number of parts. Another problem with some exercise devices is that they do not enable a user to readily ascertain a resistance setting of the exercise device. Still a further problem is that some exercise devices have an asymmetric configuration that may be uncomfortable for the user when in use. Finally, some exercise devices are limited for use only in exercising vaginal muscle groups.

In light of problems and shortcomings such as those noted above, it would be useful to provide an exercise device that is relatively simple in terms of its construction. As well, it would be useful to provide an exercise device with an adjustable resistance setting that can be readily ascertained by a user. Further, it would be useful to provide an exercise device that has a relatively symmetric configuration that does not cause discomfort to the user when in use. Finally, it would be useful to provide a device that can be readily reconfigured for use in the exercise of a variety of different muscle groups.

BRIEF DESCRIPTION OF THE DRAWINGS

In order to describe the manner in which at least some aspects of this disclosure can be obtained, a more particular description will be rendered by reference to specific embodiments thereof which are illustrated in the appended drawings. Understanding that these drawings depict only example embodiments of the invention and are not therefore to be considered to be limiting of its scope, embodiments of the invention will be described and explained with additional specificity and detail through the use of the accompanying drawings.

DETAILED DESCRIPTION OF SOME EXAMPLE EMBODIMENTS

Figure 1:
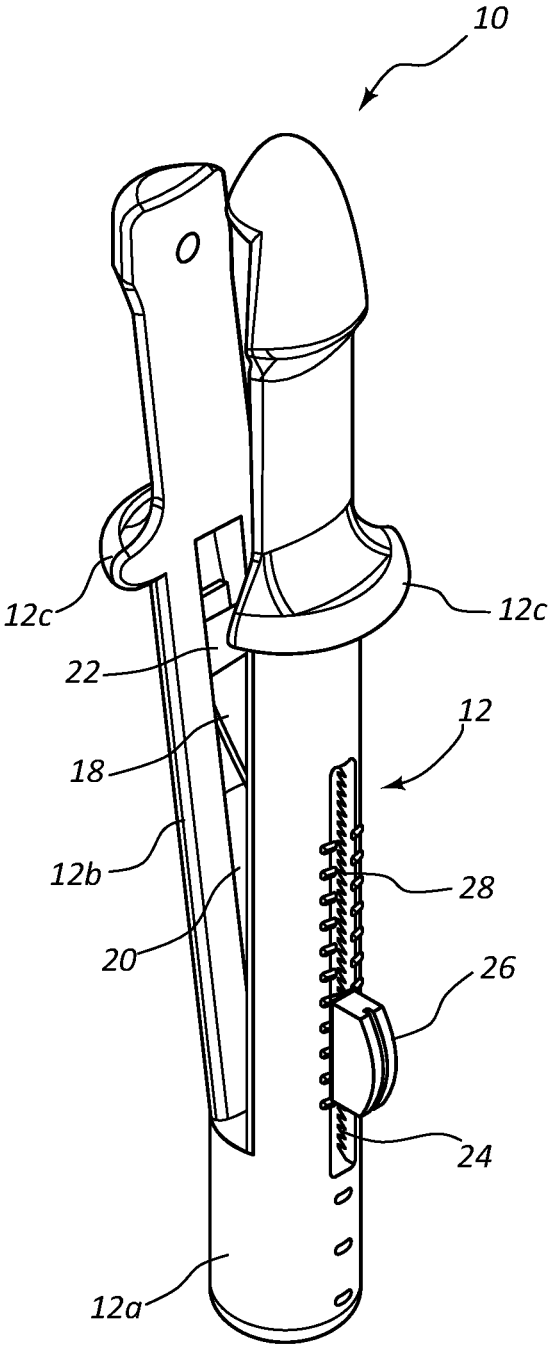
FIG. 1 is a first perspective view of an example embodiment of a muscle exercise device.
Figure 2:
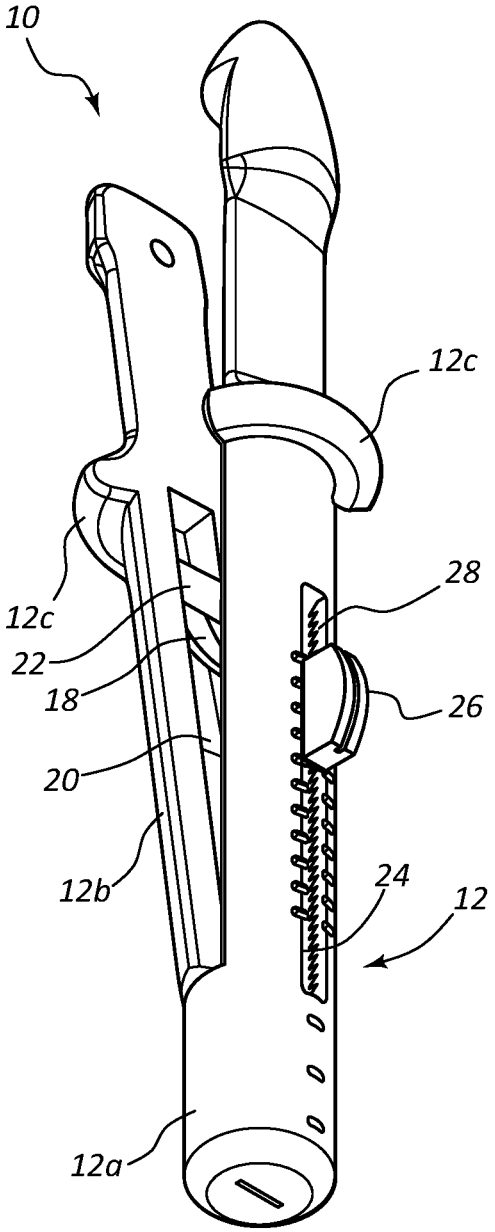
FIG. 2 is second perspective view of an example embodiment of a muscle exercise device.

Embodiments of the present invention generally concern a muscle exercise apparatus. For example, at least some embodiments of the invention relate to a muscle exercise apparatus that can be used by women, including pregnant and post-partum women, for the conditioning of various muscle groups, such as the pelvic muscle groups for example, that may be involved in the birthing process, and other processes that may be impacted by pregnancy and/or post-partum conditions.

At least some embodiments may provide a variety of benefits to the user. Examples of such possible benefits include, but are not limited to, extend muscle firmness to gain a better posture, help prevent and alleviate lower back/SI nerve problems and conditions, help tighten and hold the torso, help strengthen the inner abdominal muscles, build and tone pelvic floor muscles, help prevent prolapse, may help cure or reduce incontinence, and may strengthen the same muscles as are used when a female orgasms, that is, may help strengthen female orgasms.

In at least some embodiments, a muscle exercise apparatus includes a pair of arms connected to each other in a hinge arrangement, and sized and configured for removable insertion into the body of a user. Except for their respective hinge portions, the arms may have a substantially similar, or identical, size and configuration as each other. One or both of the arms can include an insertion stop which limits the extent to which the muscle exercise apparatus can be inserted into the body of a user.

As well, the arms cooperatively define a recess in which a single resistance element, which can be made of plastic and/or rubber, is removably disposed such that movement of the arms towards each other is elastically resisted by the resistance element. Finally, a lock may be provided to releasably lock the position of the arms relative to each other.

A. Example Embodiment With Cantilever Spring

Directing attention now to FIGS. 1-4 and 5-8, details are provided concerning various embodiments of a muscle exercise apparatus. In general, the embodiment of FIGS. 1-4 is similar, or identical, to the embodiment of FIGS. 5-8 except that the terminal portion of the embodiment of FIGS. 1-4 is shaped differently from the terminal portion of the embodiment of FIGS. 5-8, and the two parts that make up the body in the embodiment of FIGS. 1-4 have terminal portions that are substantially the same shape as each other, while the two parts that make up the body in the embodiment of FIGS. 5-8 have terminal portions that have substantially different respective shapes. Thus, in the following discussion, like parts in the two embodiments will be referred to with the same reference numbers and except as noted, the discussion of the embodiment of FIGS. 1-4 is germane to the embodiment of FIGS. 5-8.

With reference first to FIGS. 1-4, the muscle exercise apparatus 10 includes a body 12 that is generally sized and configured to be readily inserted into, and removed from, a body cavity, such as the vagina for example, of a user. The body 12 can comprise any suitable material, or materials, examples of which include, but are not limited to, plastic and rubber. One example of such a rubber is silicone rubber.

The body 12 includes first and second parts 12*a* and 12*b*, that may also be referred to herein as arms, that are movable relative to one another by virtue of a hinge 14 that joins the first and second parts 12*a* and 12*b*. In general, respective portions of the hinge 14 may be defined by the first part 12*a* and the second part 12*b*. Similarly, the body 13 of the embodiment of FIGS. 5-8 includes first and second parts 13*a* and 13*b* that are movable relative to one another by virtue of a hinge 14 that joins the first and second parts 13*a* and 13*b*. In general, respective portions of the hinge 14 may be defined by the first part 13*a* and the second part 13*b*. The body 13 also includes a stop 13*c*.

Thus configured, and as discussed in more detail below, the first and second parts 12*a* and 12*b* of the muscle exercise apparatus 10 are able to move and exert a force on a portion 16 of the body of a user, such as a muscle or muscle group for example, when the muscle exercise apparatus 10 is operably positioned within the body of the user. The body 12 may include a stop 12*c* and/or other elements that limit the extent to which the muscle exercise apparatus 10 can be inserted into the body of a user. As shown, the stop 12*c* may be cooperatively defined by the first part 12*a* and the second part 12*b* of the body 12.

As further indicated in the Figures, a spring 18 is provided that is connected to first part 12*a* of the body 12. The spring 18 can be made of any suitable material(s), examples of which include, but are not limited to, metal and plastic. In the illustrated example, the spring 18 is in the form of an elongate cantilever spring that has a fixed end 18*a* and a free end 18*b*. In general, the spring 18 is configured and arranged such that the free end 18*b*, which may curve or bend away from first part 12*a* and toward second part 12*b*, is able to exert a biasing force on second part 12*b* of the body 12. Thus, in the absence of any opposing forces or other constraints, the free end 18*b* of the spring 18 tends to cause second part 12*b* to rotate away from first part 12*a*. In the illustrated embodiment, the free end 18*b* is slidingly received in a channel 20 defined by second part 12*b* of the body 12. A retention element 22, which can take the form of a bump or other protrusion for example, positioned in or near the channel 20 prevents the free end 18*b* from moving upward out of the channel 20, but does not impair movement of the free end 18*b* back and forth along the channel 20.

With continued reference to the Figures, first part 12*a* of the body 12 defines a slot 24 that is slidingly engaged by an adjustment button 26, and the adjustment button 26 is movable back and forth along the length of the slot 24. As shown, the adjustment button 26 is configured and arranged to contact an upper surface of the spring 18 as the adjustment button 26 moves along the slot 24. More particularly, the adjustment button 26 includes a contact portion 26*a* that slidingly contacts the spring 18. The contact portion 26*a* is relatively wider than the slot 24, thus ensuring that the adjustment button 26 cannot be pulled upward out of the slot 24. The adjustment button 26 may include ridges 26*b* and/or other elements that may help to prevent a hand or finger of the user from slipping off of the adjustment button 26.

Figure 3:
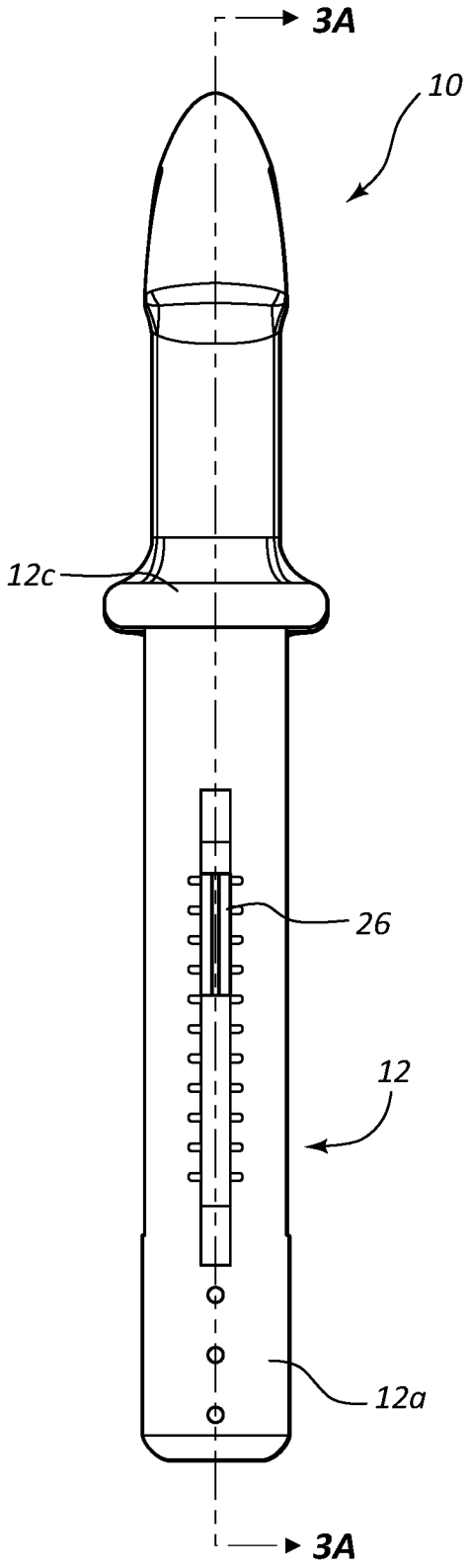
FIG. 3 is a top view of an example embodiment of a muscle exercise device showing a resistance setting indicator.
Figure 4:
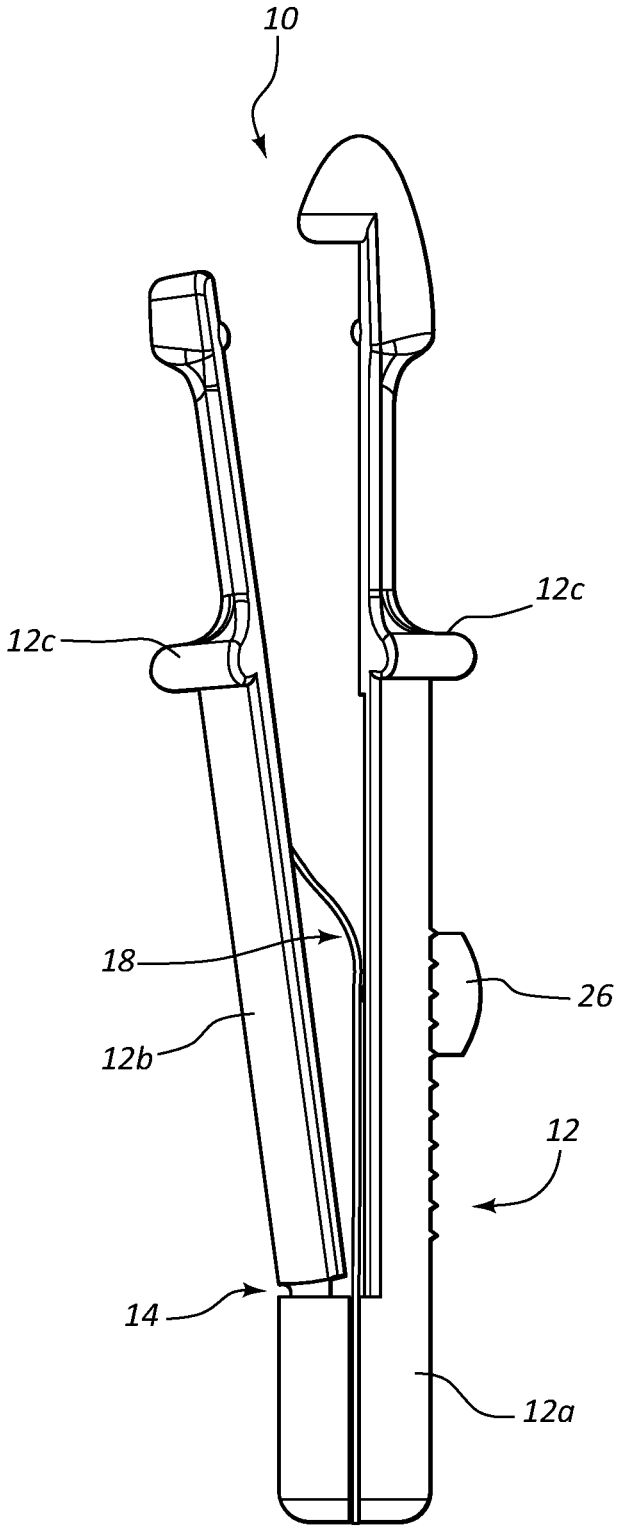
FIG. 4 is a side view of an example embodiment of a muscle exercise device showing the muscle exercise device in a biased open state.
Figure 3A:
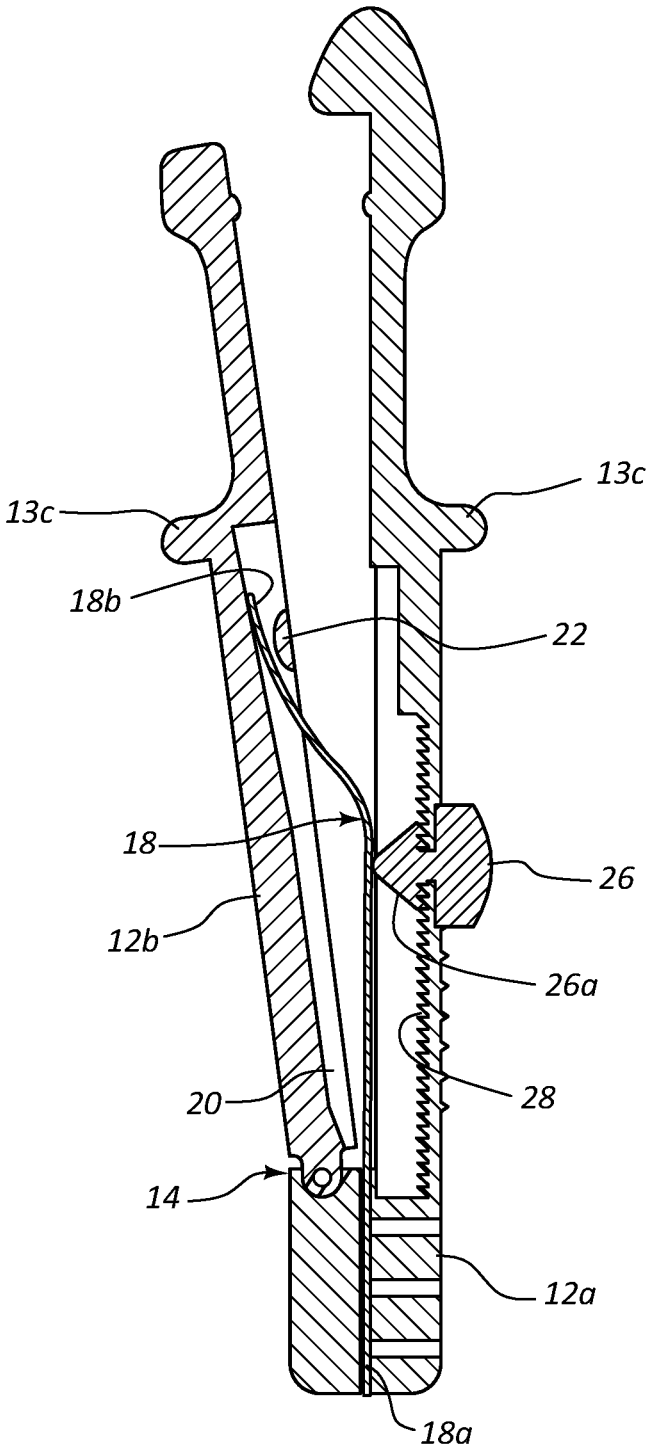
FIG. 3*a* is a section view of the example embodiment of FIG. 3.
Figure 5:
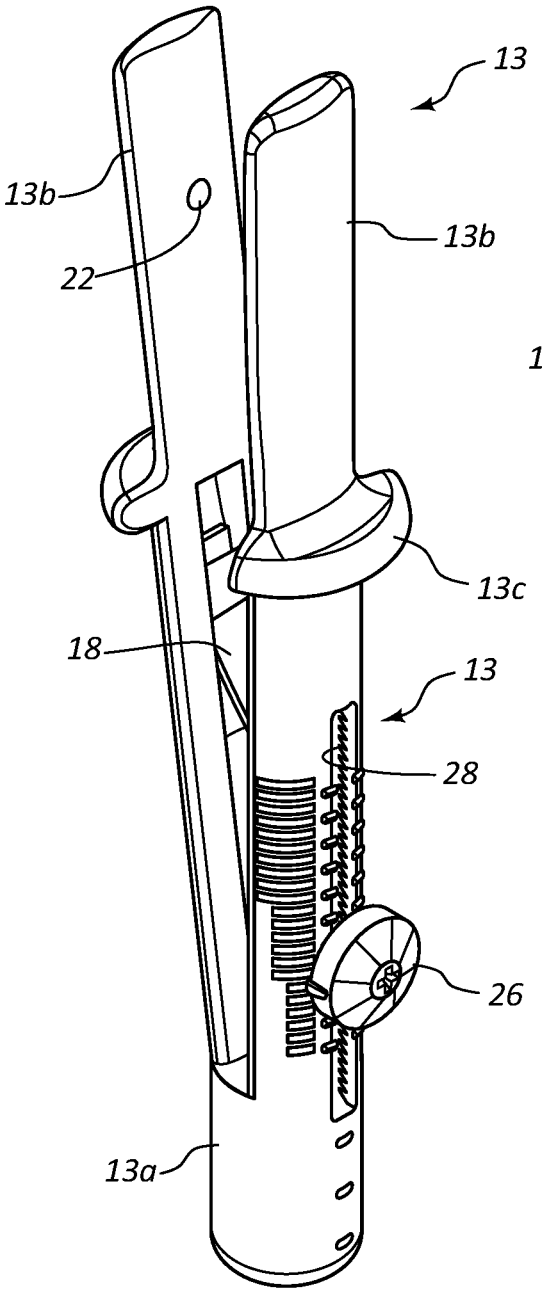
FIG. 5 is a first perspective view of another example embodiment of a muscle exercise device.
Figure 6:
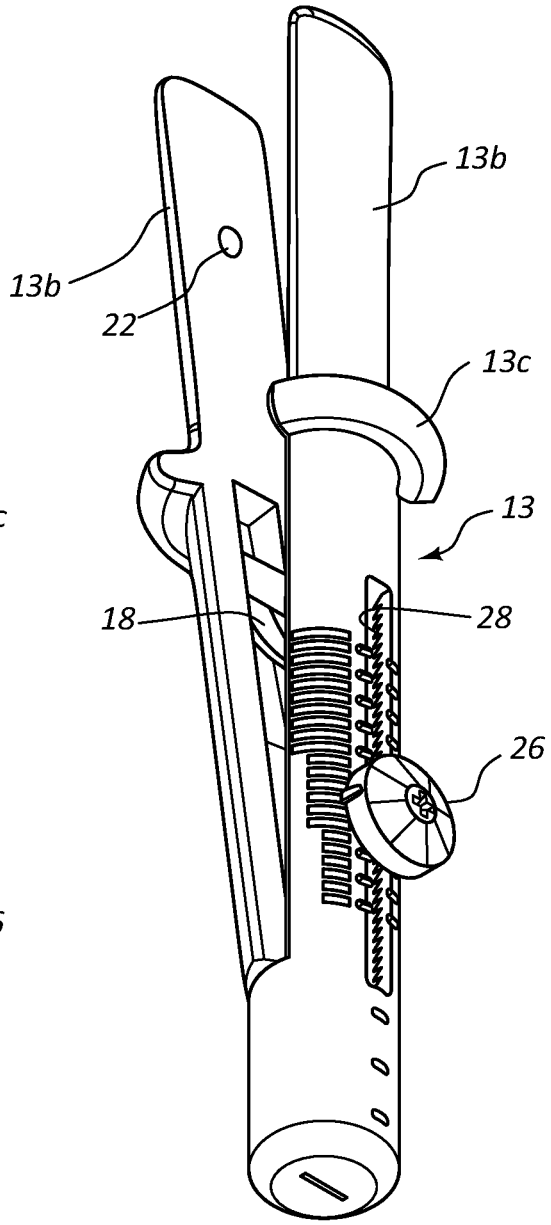
FIG. 6 is second perspective view of the example embodiment of FIG. 5.
Figure 8:
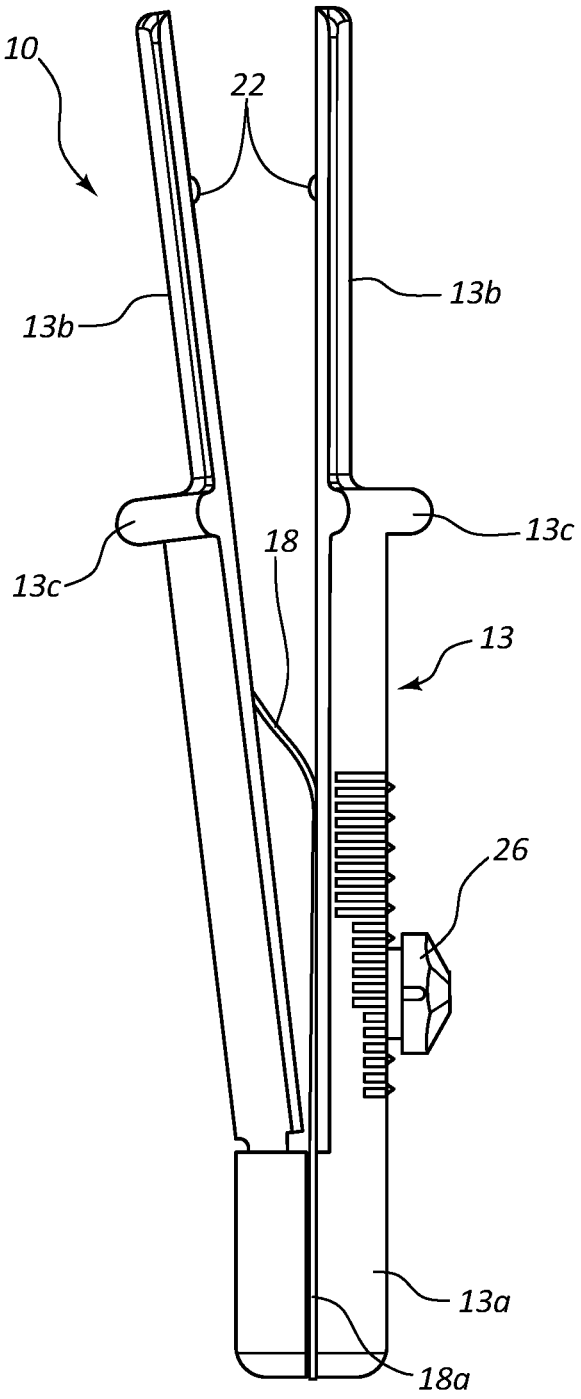
FIG. 8 is a side view of an example embodiment of FIG. 5, showing the muscle exercise device in a biased open state.

As best shown in FIGS. 3, 3*a* and 4, the underside of first part 12*a* near the slot 24 may include a plurality of first complementary structure(s) 28, such as serrations and/or other structures for example, that releasably engage second complementary structure(s) 26*c* of the adjustment button 26. In general, movement of the adjustment button 26 along the slot 24 is substantially prevented when the second complementary structures 26*c* are engaged with the first complementary structures 28.

In terms of its operation, and as best shown in FIGS. 3 and 3*a*, the adjustment button 26 is biased by the spring 18 into a position where the second complementary structures 26*c* are engaged with the first complementary structures 28. Thus, in order that the adjustment button 26 can be moved to a different position in the slot 24, a downward force must be exerted on the adjustment button 26, and the adjustment button 26 moved to the desired position. When the downward force is released, the adjustment button 26 will be held in the new position by the combined action of the spring 18 on the adjustment button 26, and the engagement of the first and second complementary structures 28 and 26*c*.

In light of the foregoing discussion, it should be apparent from FIG. 3, for example, that the biasing force exerted by the spring 18 on the second part 12*b* of the body 12 can desirably be adjusted by changing the position of the adjustment button 26 in the slot 24 such that a longitudinal position of the adjustment button 26 relative to a length of the spring 18 is changed. More specifically, and with reference to FIGS. 4*a* and 4*b*, movement of the adjustment button 26 to the right increases the effective length of the spring 18, that is, the portion of the spring 18 that can be utilized to exert a biasing force on the second part 12*b* of the body 12. Thus, as the effective length of the spring 18 is shortened as a result of movement of the adjustment button 26 from the position shown in FIG. 4*a* to the position shown in FIG. 4*b*, the effective length of the spring 18 is biased to increasingly resist movement of the parts 12*a* and 12*b* toward one another.

With reference now to FIGS. 9*a*-9*d*, and FIGS. 10*a*-10*d*, further details are provided concerning example embodiments of the spring 18 and adjustment button 26, respectively. Turning first to FIGS. 9*a*-9*d*, the spring 18, when in a relaxed state, may include a relatively flat fixed end portion 18*c* that, in turn, is abutted by an angled portion 18*d* that describes an angle relative to the fixed end portion 18*c*. The angle can be selected as desired to obtain a desired range of biasing forces when the spring 18 is in use. A convex portion 18*e* connects to the angled portion 18*d* at one end, and to a concave portion 18*f* at the other end. The respective radii of curvature of the convex portion 18*e* and concave portion 18*f* can be selected as desired. Thus, the illustrated radii are provided by way of example only.

Turning finally to FIGS. 10*a*-10*d*, further details are provided concerning the example embodiment of the adjustment button 26. In terms of its construction, the adjustment button 26 can be made of any suitable material(s), examples of which include, but are not limited to, metal, plastic, rubber, ceramic, and wood. As noted earlier, the adjustment button 26 can include one or more ridges 26*b*, as well as one or more second complementary structures 26*c*.

B. Example Embodiments With Resistance Element

Figure 11A:
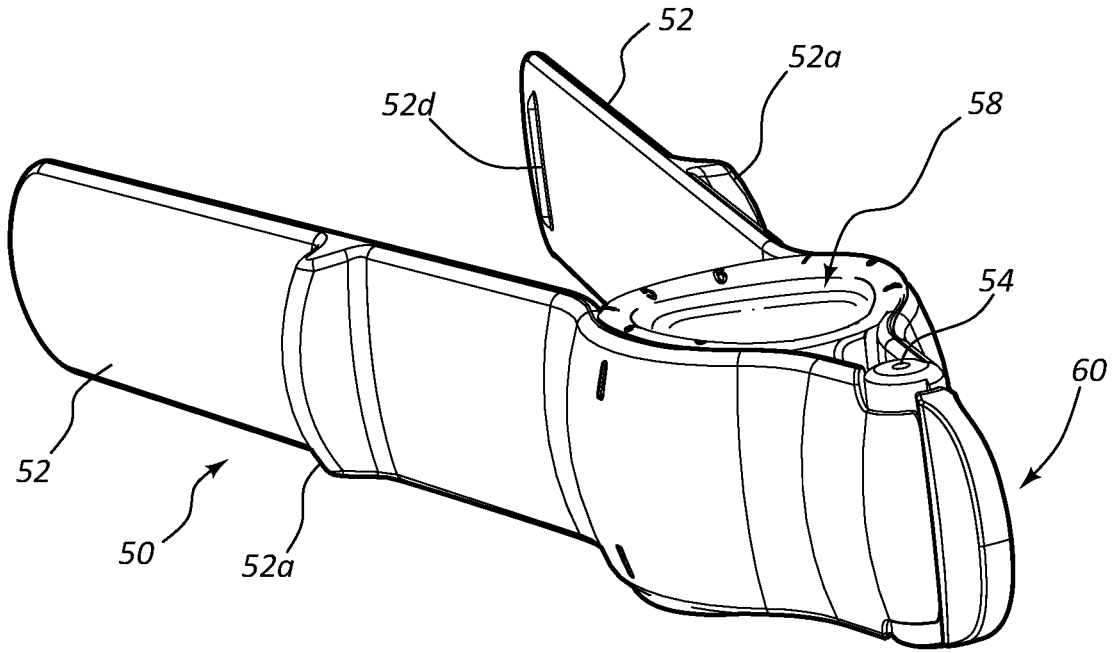
FIG. 11*a* is a front perspective view of another example embodiment of a muscle exercise device showing the muscle exercise device in a biased open state.
Figure 11B:
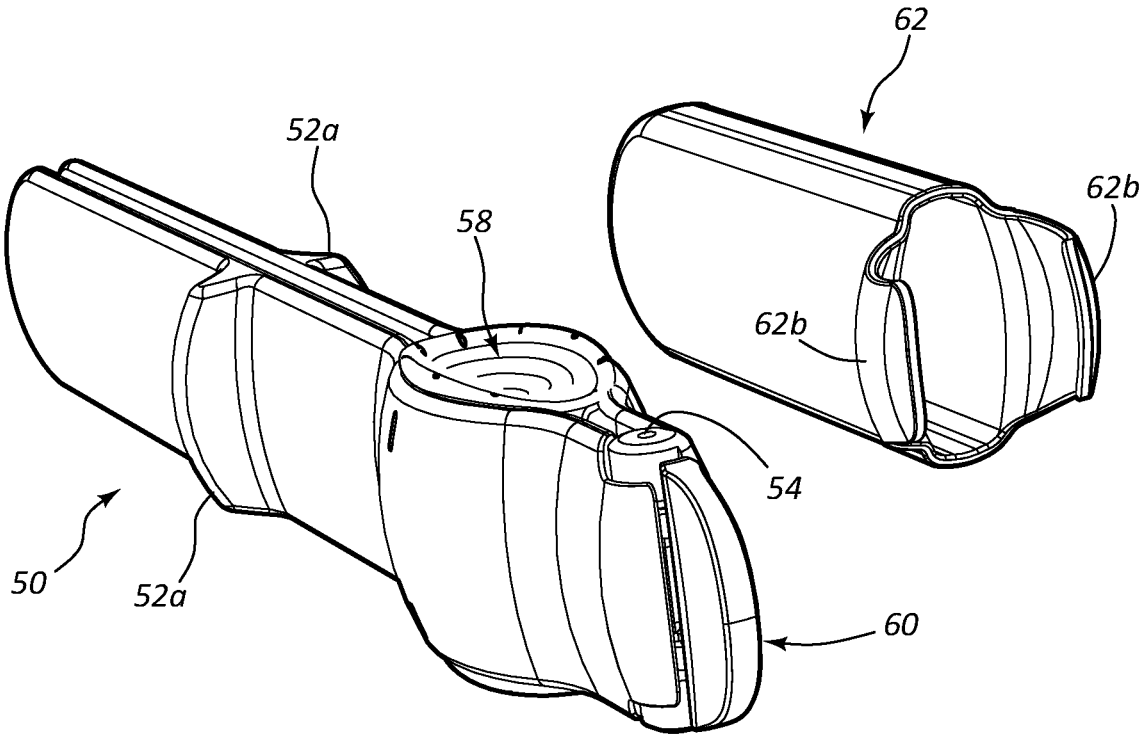
FIG. 11*b* is a front perspective view of the embodiment of FIG. 11*a* showing the muscle exercise device in a closed state.
Figure 11C:
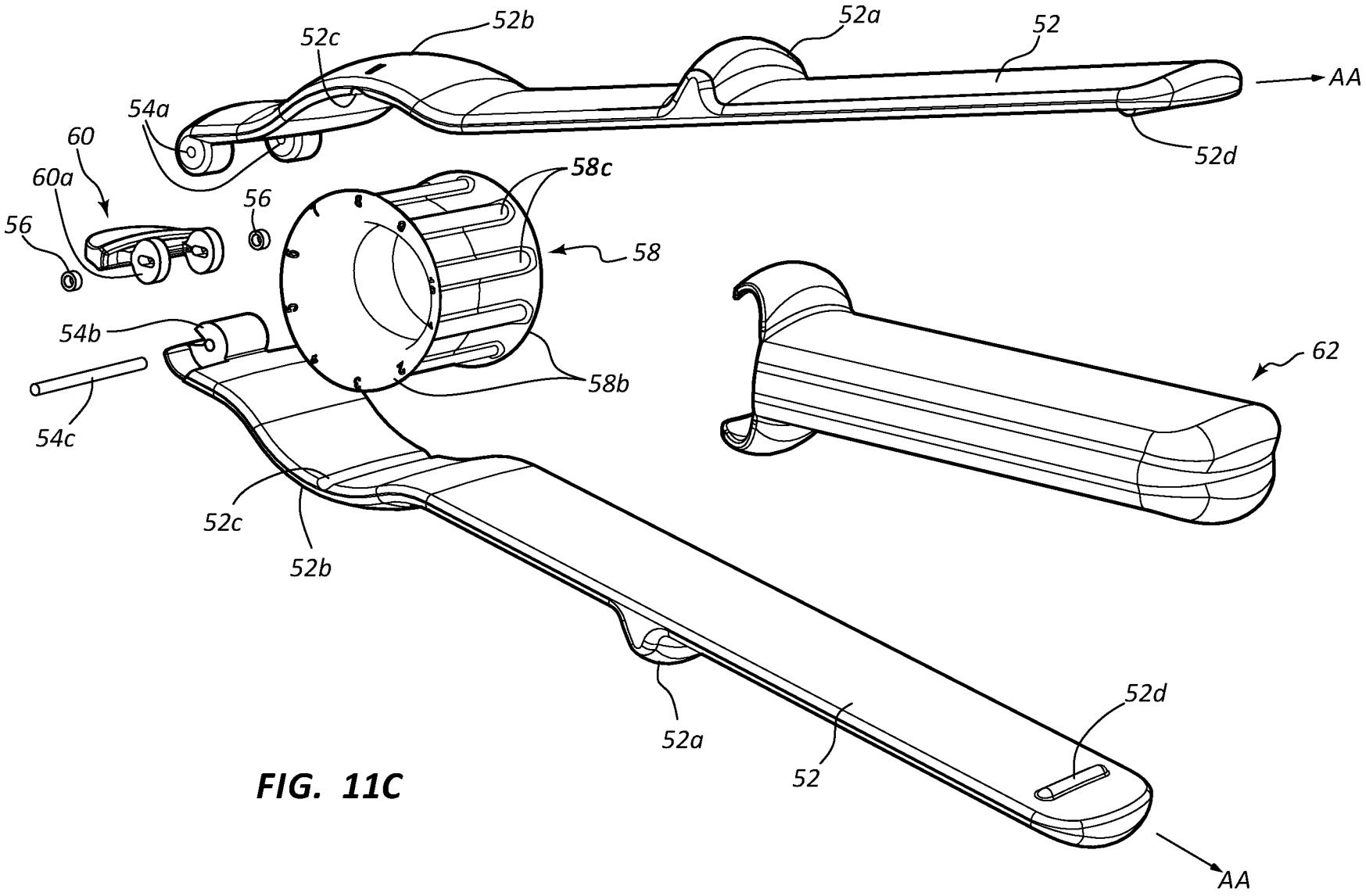
FIG. 11*c* is an exploded perspective view of the embodiment of FIG. 11*a*.

Directing attention first to FIGS. 11*a*-11*e*, details are provided concerning another embodiment of a muscle exercise device, denoted generally at 50. With regard initially to FIGS. 11*a*-11*c*, the muscle exercise device 50 may include a pair of arms 52 that are connected to each other by way of a hinge 54. As best shown in FIG. 11*c*, each of the arms 52 may define, or otherwise include, a respective portion 54*a* and 54*b* of the hinge 54, and the portions 54*a* and 54*b* are connected to each other by a pin 54*c* that passes through holes respectively defined by portions 54*a* and 54*b*. The arms 52 can be made of any suitable material(s), examples of which include, but are not limited to, plastic and rubber. As further indicated in the Figures, one or both of the arms 52 may include a stop 52*a*, which can be integral with the arm 52, and which serves to limit the extent to which the muscle exercise device 50 can be inserted into the body of a user.

With particular reference now to FIG. 11*c*, one or both of the arms 52 may further include a concave portion 52*b* such that when respective concave portions 52*b* of the arms 52 are disposed generally opposite each other, a recess 56 of variable size is cooperatively defined by the oppositely disposed concave portions 52*b*. One or both of the concave portions 52*b* can be in the form of an arc, such as of a circle or ellipse for example, and may define a slot 52*c* that is laterally oriented relative to a longitudinal axis AA of the corresponding arm 52. In general, and as discussed below, the slot 52*c* may be configured and arranged to receive a corresponding portion of a resistance element 58 so as to facilitate retention of the resistance element 58 in the recess 56.

One or both of the arms 52 may include a standoff 52*d* that extends outward from an inner surface of the arm 52. In general, the standoff(s) 52*d* can serve to limit the extent to which the arms 52 can be closed together. That is, once the standoffs 52*d* contact each other, no further motion of one arm 52 toward the other arm 52 is possible and a gap may be present between the two arms 52. The standoffs 52*d* may thus also limit the extent to which a resistance element 58 can be compressed by the arms 52.

In the example embodiment disclosed in the Figures, the resistance element 58 is configured, and arranged relative to the arms 52, such that the arms 52 can exert a compression force on the resistance element 58 that is substantially radially oriented with respect to the resistance element 58. That is, in at least some embodiments, the resistance element 58 in use is compressed substantially in a radial direction and to a relatively lesser extent, or not at all, in an axial direction. Thus, the arms 52 may also exert a compression force on the resistance element 58 that is axially oriented with respect to the resistance element 58. In at least some embodiments, the magnitude of the radial force exceeds the magnitude of the axial force, although that is not required.

Figure 7:
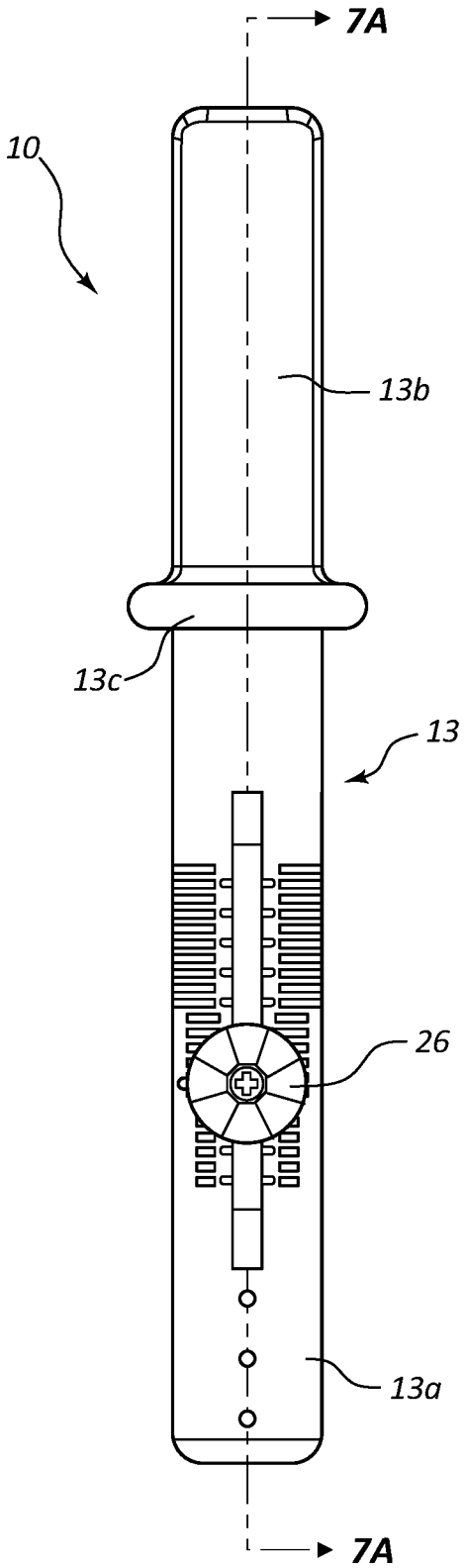
FIG. 7 is a top view of an example embodiment of FIG. 5.
Figures 7A, 7B, 7C:
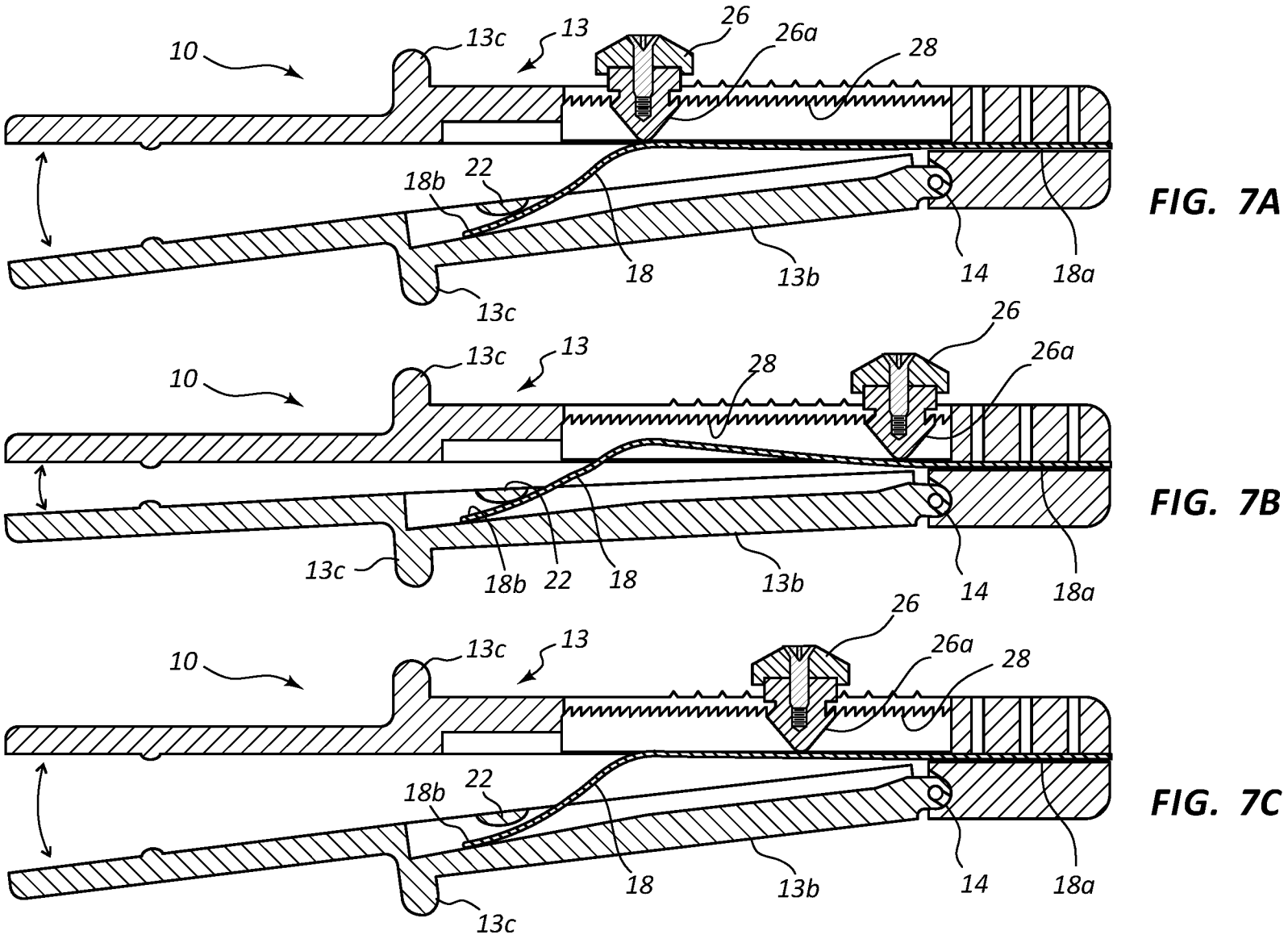
FIG. 7*a* is a section view taken from FIG. 7, showing the muscle exercise device at a relatively high resistance setting.
FIGS. 7*b*-7*c* are section views taken from FIG. 7 and showing the muscle exercise device at a relatively low resistance setting, and an intermediate resistance setting, respectively.

As further indicated in FIGS. 11*a*-11*c*, and discussed in more detail below, embodiments of the muscle exercise apparatus 50 may include one or both of a lock 60 and a cover 62. In general, the lock 60 enables a user to lock the arms 52 together, as shown in FIG. 7*b* for example, when the muscle exercise apparatus 50 is not in use. The cover 62 can be used to help prevent foreign matter from contacting the lower portions of each arm 52 when the muscle exercise apparatus 50 is not in use.

Figure 11D:
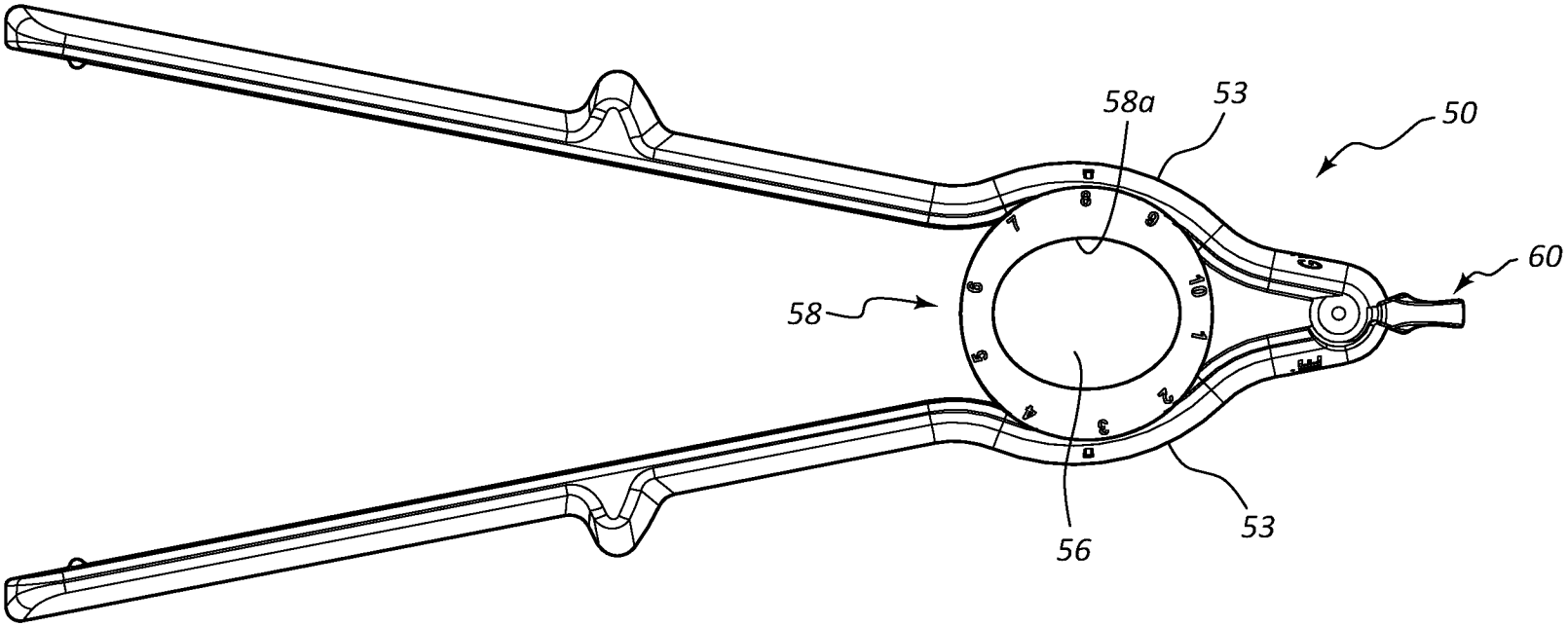
FIG. 11*d* is a side view of the embodiment of FIG. 11*a* showing the muscle exercise device in a biased open state.
Figure 11E:
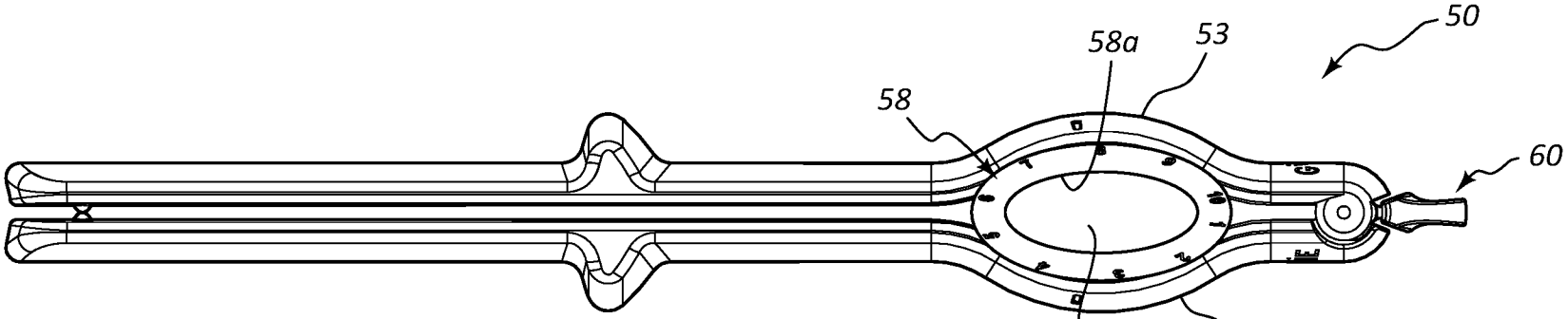
FIG. 11*e* is a side view of the embodiment of FIG. 11*a* showing the muscle exercise device in a closed state.

Turning now to FIGS. 11*d* and 11*e*, and with continuing attention to FIGS. 11*a*-11*c*, further details are provided concerning aspects of the operation of the muscle exercise apparatus 50. As noted earlier, embodiments of the muscle exercise apparatus 50 can employ a resistance element 58 which is generally constructed of an elastically compressible material which has spring properties such that the resistance to compression offered by the resistance element 58 increases in proportion with the compression force exerted on the resistance element 58 as the two arms 52 move toward each other in use. At least some embodiments employ no more than a single resistance element 58.

In terms of its construction, the resistance element 58 is not limited to any particular size or configuration. In one example embodiment, the resistance element 58 has an outside diameter in the range of about 1.5 inches to about 2.5 inches, and has a resistance range of about 1 pound to about 10 pounds. Of course, different sizes and resistance ranges can alternatively be employed. Other example embodiments may also have an outside diameter in the range of about 1.5 inches to about 2.5 inches, but may have a different resistance range than the aforementioned example as a result of a relatively thinner, or thicker, wall 58*a*. As a final example, a resistance element with walls of the same thickness as the first example noted above may have a relatively smaller outside diameter and, thus, a correspondingly different resistance range. In general then, and as illustrated by the foregoing examples, a variety of different attributes of the resistance element 58 may be changed from one embodiment to the next so as to produce a resistance element 58 of the desired size, configuration, and resistance range.

Insofar as at least some of the resistance elements are compressible and elastically deformable, the resistance force provided by a resistance element can be described by the formula $F=kX$, where F is the resistance force provided by the resistance element, k is a spring constant that is characteristic of the material of which the resistance element is made, and X is the distance that the resistance element is deflected when in use by the user.

In at least some embodiments, the muscle exercise device can be sold as a kit that includes a pair of arms rotatably connected to each other, and a cover in which the arms can be partly received. Such a kit may also include a set of multiple resistance elements, such as four resistance element for example, each of which provides a particular resistance, or range of resistances, to a user when employed in the muscle exercise device. As noted below, each resistance element can include one or more indicators that inform the user of the resistance, or range of resistances, offered by that particular resistance element. In some instances, the indicator(s) can indicate the minimum and maximum resistance, or only the maximum resistance. However, the scope of the invention is not limited to any particular indicator, or group of indicators.

The resistance element 58 may be of any suitable construction. For example, the resistance element 58 can be solid, or hollow as shown in the Figures, and can be made of materials such rubber and/or plastic. In some particular embodiments, the resistance element 58 is made of silicone rubber. A variety of processes, such as molding for example, can be used to form the resistance element 58. In the illustrated example, the resistance element 58 has a shape that may be generally tubular with a generally circular cross-section shape when the resistance element 58 is undeformed, although oval or elliptical undeformed shapes could alternatively be used.

The resistance element 58 may, in some embodiments, have a unitary single piece construction. In other embodiments, the resistance element 58 can be made of multiple discrete pieces.

As well, the resistance element 58 may include one or more ribs 58*c* or other structures that are configured and arranged to be removably received in corresponding slots 52*c* or other structures of one or both of the arms 52. The ribs 58*c* may help to retain the resistance element in position between the arms 52 when the muscle exercise apparatus 50 is in use. Retention of the resistance element 58 between the arms 52 can be further aided by flanges 58*b* on opposing sides of the resistance element. More particularly, and as shown in FIGS. 7*a*, 7*b* and 7*d* for example, the flanges 58*b* can partially, or completely in some embodiments, extend outside the outer edges 53 of the concave portions 52*b* of the arms 52, such that significant lateral movement of the resistance element 58 relative to the recess 56 is substantially, or even completely, prevented when the muscle exercise apparatus 50 is in use.

Depending upon the use to which the muscle exercise apparatus 50 is intended to be put, resistance element 58 can be interchangeable with one or more other resistance elements (not shown) that may have different respective resistance properties. For example, resistance elements can vary from one another in terms of one or more of their size, shape, and construction material(s). As well, different resistance elements can be marked in some fashion, such as with the use of colors or numbers for example, so that a user can readily discern the actual and/or relative resistance associated with a particular resistance element. For example, colors, numbers, lines, dots, bumps, ridges, recesses, and/or any other indicia that is/are perceptible by one or more senses of a user and that indicate to the user a relative resistance level, or range of resistance levels, offered by a particular resistance element. One useful aspect of the use of such indicia is that the user is able to perceive progress in muscle development as the user moves from one resistance element to the next resistance element.

The amount of resistance offered by any particular resistance element can vary. In one example embodiment, a set of four resistance elements are provided in which the first resistance element provides three different resistance levels, each in a range of about 0.0 lbs. to about 3.0 pounds. The second resistance element in this example set provides three different resistance levels, each in a range of about 3.0 lbs. to about 6.0 pounds. The third resistance element in this example set provides three different resistance levels, each in a range of about 6.0 lbs. to about 9.0 pounds. The fourth resistance element in this example set provides three different resistance levels, each in a range of about 9.0 lbs. to about 12.0 pounds. Of course, different numbers of resistance elements, with different resistance ranges, can alternatively be used, and the foregoing are presented only by way of example.

As indicated in the Figures, it is a simple matter to remove the resistance element 58 from the muscle exercise apparatus 50. Particularly, the arms 52 can be moved apart from each other, and the resistance element 58 removed from the recess 56. In this way, a user can readily tailor the resistance offered by the muscle exercise apparatus 50, based on variables such as, but not limited to, the muscle group(s) intended to be exercised, and the particular exercise(s) to be performed. As well, the configuration of the muscle exercise apparatus 50 may also be advantageous inasmuch as the resistance element 58 can be readily removed for cleaning.

The foregoing thus makes clear that embodiments of the muscle exercise apparatus 50 are not limited solely to use by pregnant and post-partum women. For example, at least some embodiments of the muscle exercise apparatus 50 may be grasped, and repeatedly squeezed, by the hand of a user to exercise the hand muscles of the user. Another embodiment of the muscle exercise apparatus 50 can be sized and configured to be placed between the knees of user so that compression of the muscle exercise apparatus 50 by movement of the knees of the user exercises various muscle groups of the legs of the user.

Figure 12A:
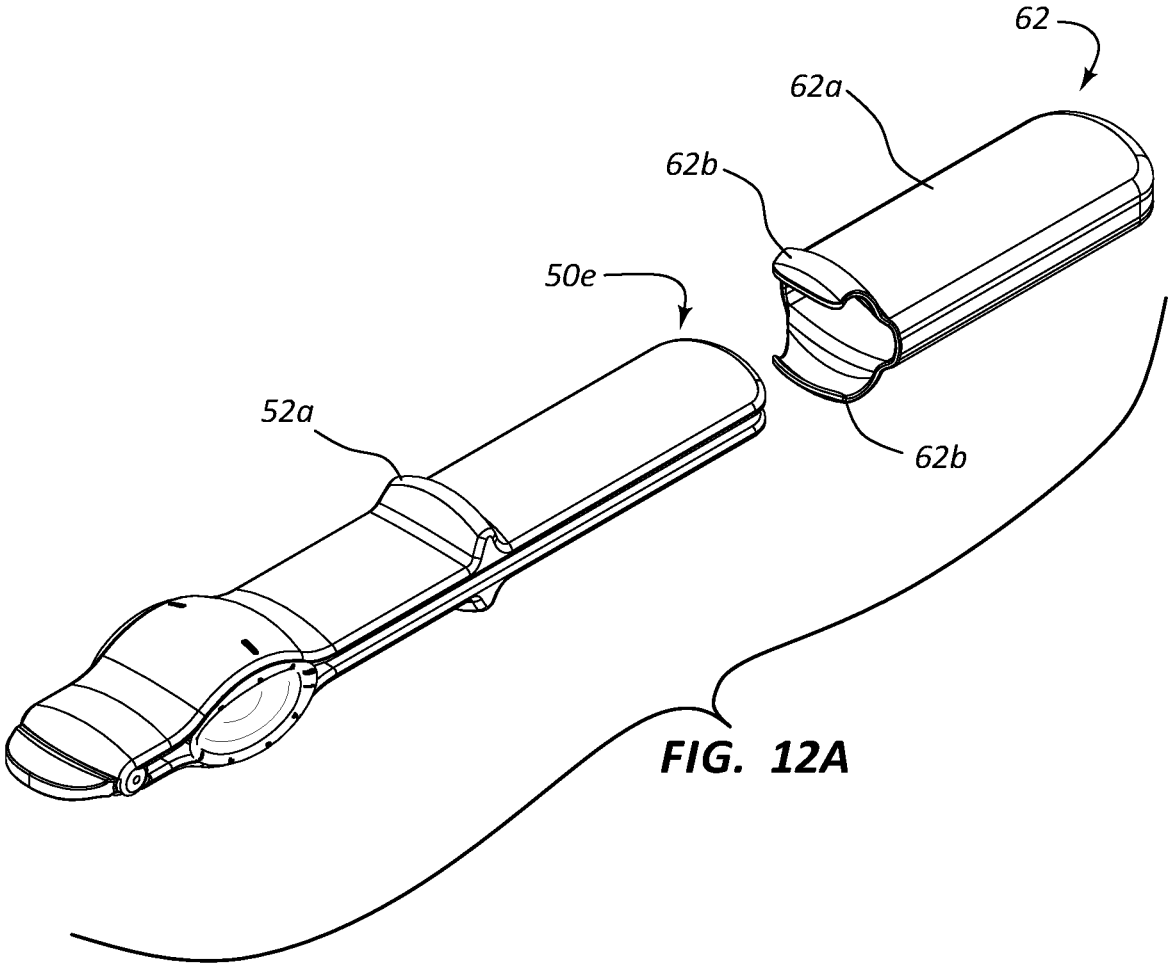
FIG. 12*a* is a side view of the embodiment of FIG. 11*a* showing a cover arranged to be positioned on the muscle exercise device.
Figure 12B:
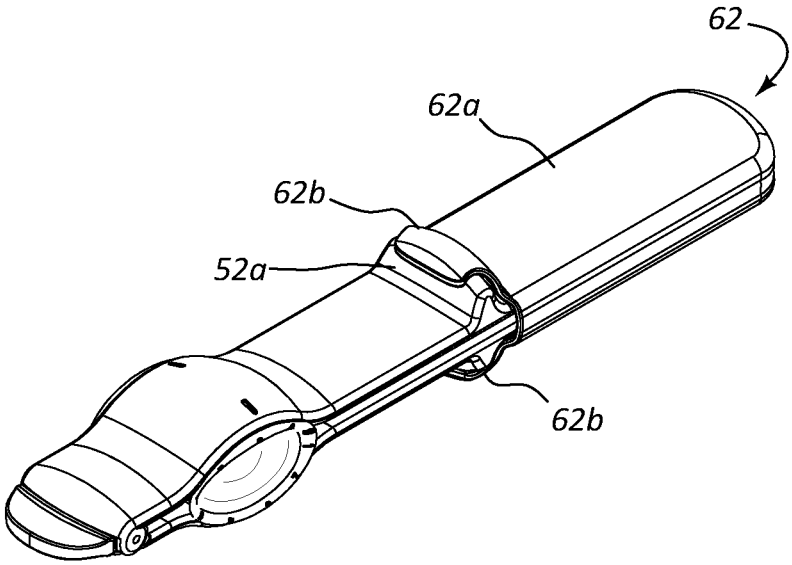
FIG. 12*b* is a side view of the embodiment of FIG. 11*a* showing a cover in place.

With particular reference now to FIGS. 12*a* and 12*b*, further details are provide concerning a cover, one example of which is denoted at 62. The cover 62 can be made of plastic, rubber and/or any other suitable material(s). The example cover 62 includes a body 62*a* that defines a cavity sized and configured to removably receive a portion of the muscle exercise apparatus 50. In the illustrated example, the length of the hollow body 62*a* is sufficient to accommodate the portion of the muscle exercise apparatus 50 extending from the insertion end 50*e* to a location proximate the stops 52*a*. As well, the cover 62 may include one or more lips 62*b* that snap fit over a respective stop 52*a* so as to removably retain the cover 62 in position.

Figure 13A:
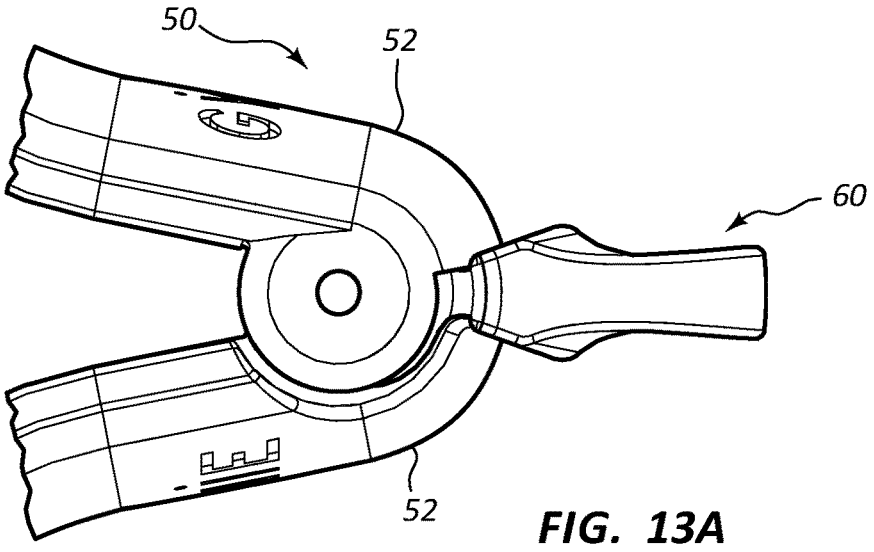
FIG. 13*a* is a partial view of the embodiment of FIG. 11*a* showing the muscle exercise device in an unlocked state.
Figure 13B:
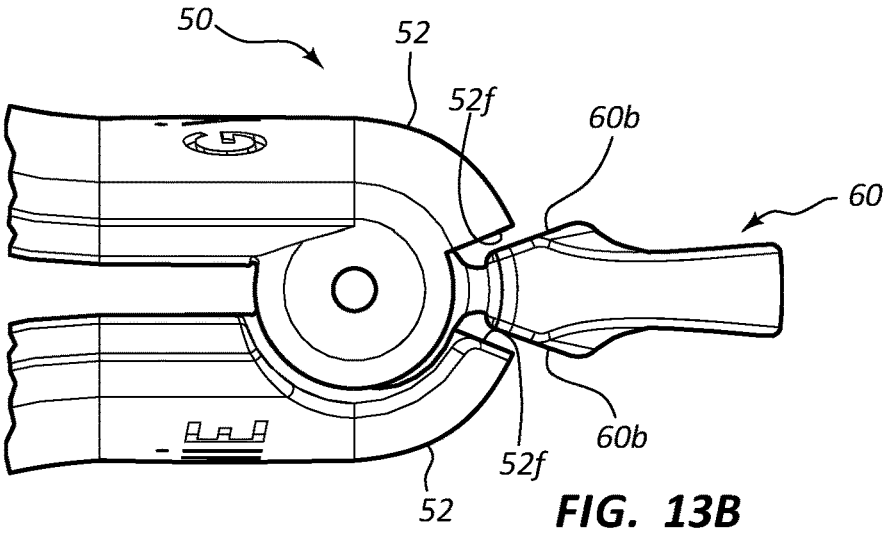
FIG. 13*b* is a partial view of the embodiment of FIG. 11*a* showing the muscle exercise device in transition between an unlocked state and a locked state.
Figure 13C:
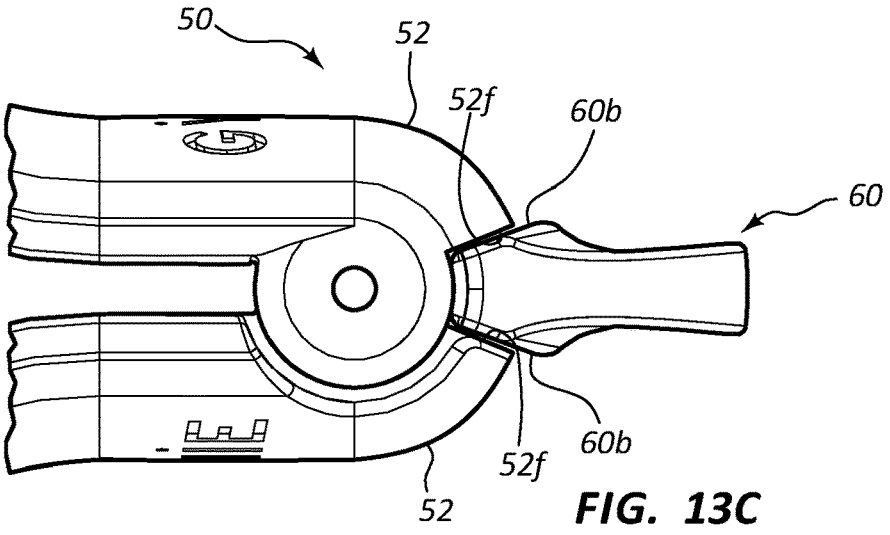
FIG. 13*c* is a partial view of the embodiment of FIG. 11*a* showing the muscle exercise device in a locked state.

Turning finally to FIGS. 13*a*-13*c*, and with continuing attention to FIG. 11*c*, further details are provide concerning a lock, one example of which is denoted at 60. The lock 60 can be made of plastic, rubber and/or any other suitable material(s). As best shown in FIG. 11*c*, the lock 60 includes a pair of elongated holes 60*a* through which the pin 54*c* (FIG. 7*c*) passes. Although the pin 54*c* thus prevents the lock 60 from becoming detached from the muscle exercise device 50, the elongated holes 60*a* enable the lock 60 to slide relative to the pin 54*c*, generally along the longitudinal axis AA defined by the muscle exercise device 50. In general, and as discussed in more detail below, locking and unlocking of the muscle exercise device 50 can be effected by moving the lock 60 toward, or away from, respectively, the hinge 54.

As shown in FIG. 13*a*, the lock 60 is in the use position, that is, a position where the arms 52 can move relative to each other and unimpeded by the lock 60. This is the position that the lock 60 would thus be in when a user is using the muscle exercise device 50. When the user desires to lock the muscle exercise device 50, and with particular reference to FIG. 13*b*, the arms 52 are moved into contact, or nearly so, with each other, thereby exposing respective stopping surfaces 52*f* of each of the arms 52. In the illustrated example, the stopping surfaces 52*f* are disposed at an angle relative to each other, where the angle is between about 0 degrees and about 45 degrees, although angles of other sizes, larger or smaller, could be implemented.

Figure 9A:
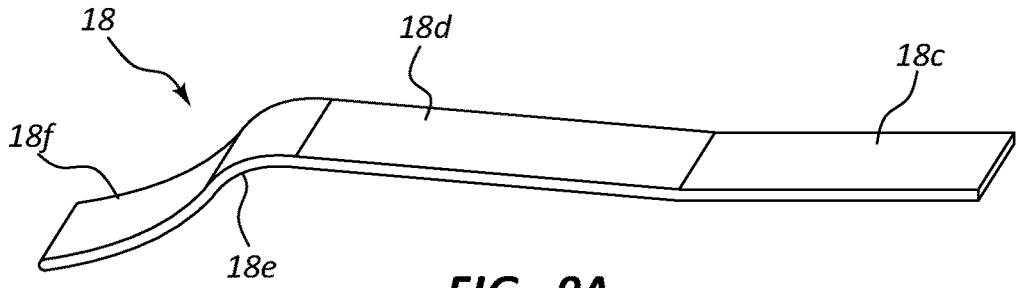
FIG. 9*a* is a perspective view of an example embodiment of a spring.
Figure 9C:
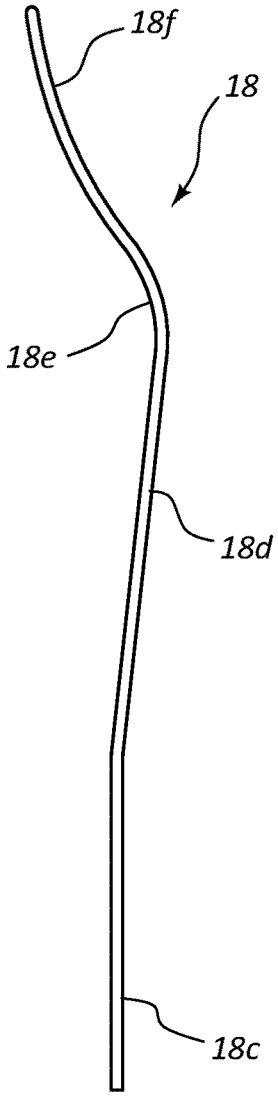
FIG. 9*c* is a side view of the spring of FIG. 9*a*.
Figure 9B:
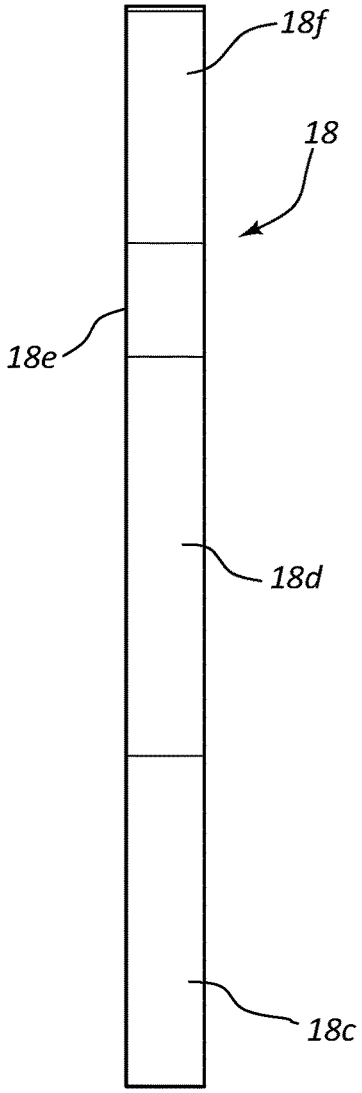
FIG. 9*b* is a top view of the spring of FIG. 9*a*.
Figure 9D:
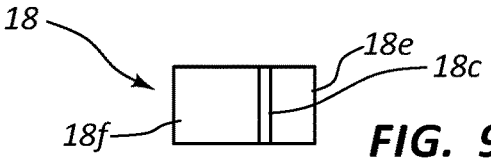
FIG. 9*d* is an end view of the spring of FIG. 9*a*.
Figure 10C:
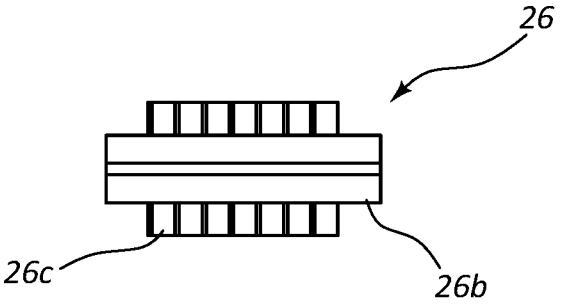
FIG. 10*c* is a top view of the adjustment button of FIG. 10*a*.
Figure 10A:
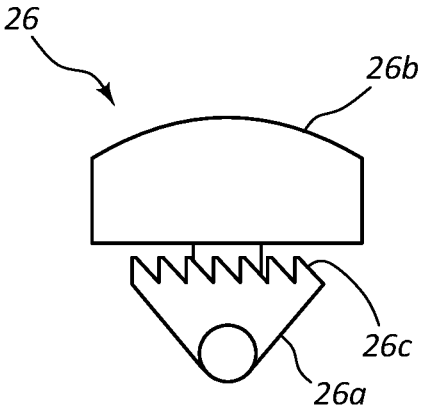
FIG. 10*a* is a side view of an example embodiment of an adjustment button.
Figure 10B:
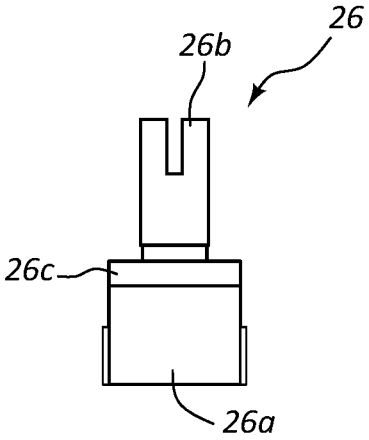
FIG. 10*b* is a front view of the adjustment button of FIG. 10*a*.
Figure 10D:
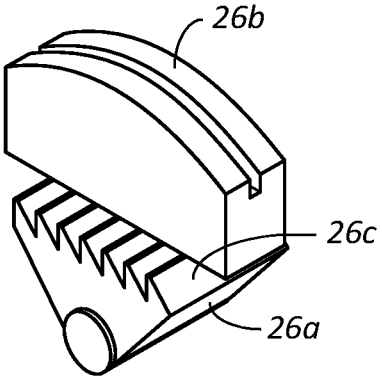
FIG. 10*d* is a perspective view of the adjustment button of FIG. 10*a*.

The lock 60 correspondingly includes a pair of locking surfaces 60*b* which cooperate with each other to define an angle that may be approximately the same as the angle collectively defined by the stopping surfaces 52*f*. Thus configured, the locking surfaces 60*b* collectively form a wedge that, when inserted in the gap between the stopping surfaces 52*f* (see FIG. 13*b*) such that the locking surfaces 60*b* contact respective stopping surfaces 52*f*, prevents rotation of the arms 52 away from each other, as shown in FIG. 9*c*. As noted above, insertion of the lock 60 in this way is enabled by the elongated holes 60*a* which permit the position of the lock 60 relative to the arms 52 to be adjusted.

To unlock the muscle exercise device 50, the user can simply grasp the lock 60 and move the lock 60 from the position shown in FIG. 13*c* to the position shown in FIG. 13*a*. It should be noted that the lock 60 is optional and not required for any particular embodiment. In some instances at least, the cover 62 can serve to retain the arms 52 in a closed position, as shown in FIG. 12*b* for example.

With reference next to FIGS. 14*a*-15*c*, details are provided concerning an alternative embodiment of the muscle exercise device, denoted generally at 70. The alternative embodiment may be similar, or identical, to the embodiment of FIGS. 11-13*c*, except as noted below. Accordingly, the discussion below will be limited to selected aspects of the muscle exercise device 70.

In general, the muscle exercise device 70 is similar in terms of its structure and operation to the muscle exercise device 50, except that the muscle exercise device 70 omits a lock, whereas the muscle exercise device 50 includes a lock 60. Thus, the muscle exercise device 70 may include a pair of arms 72 that are connected to each other by way of a hinge 74. The arms 72 can be similar, or identical, to each other. As well, when the arms 72 are folded together, the arms 72 can be at least partly received in a cover 76, and thereby constrained from rotational motion relative to each other. The muscle exercise device 70 may also include a resistance element 78 that can be removably positioned between the arms 72, as shown in FIGS. 14*a* and 14*d*.

Figure 14A:
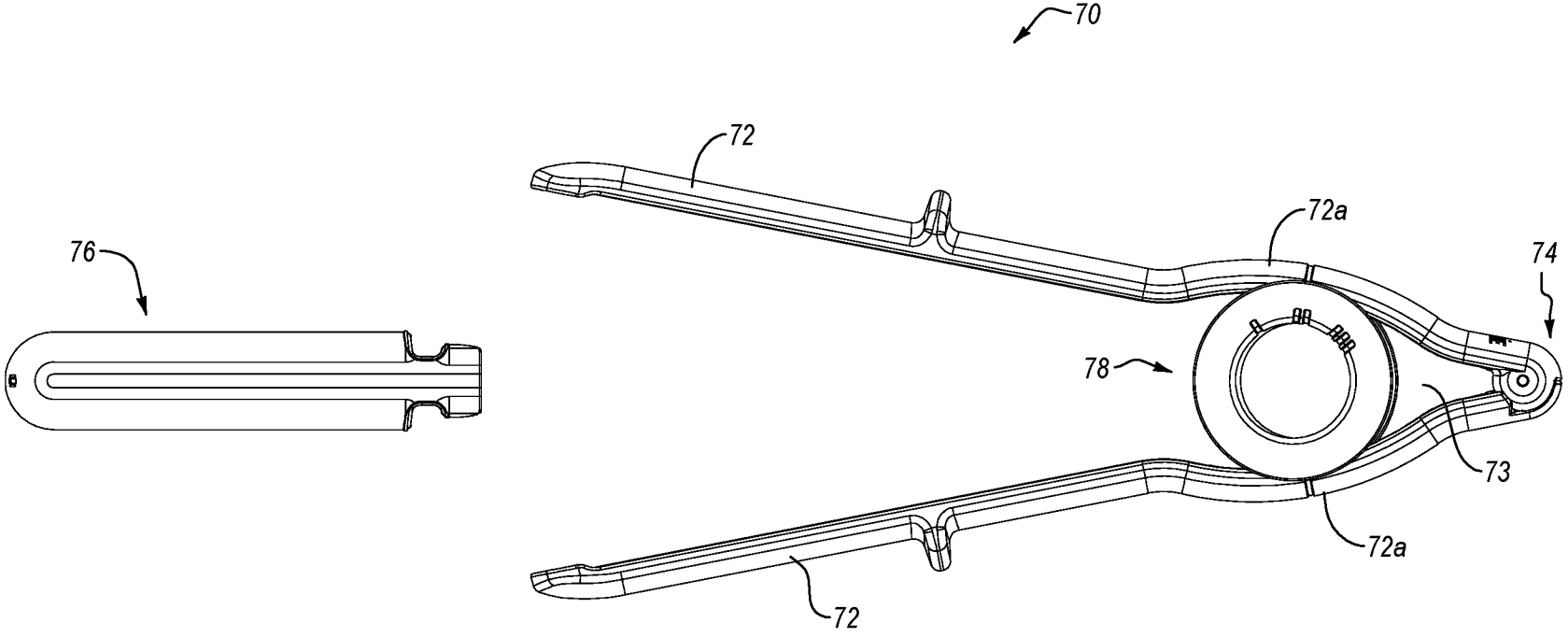
FIG. 14*a* is a side view of another example embodiment of a muscle exercise device.
Figure 14B:
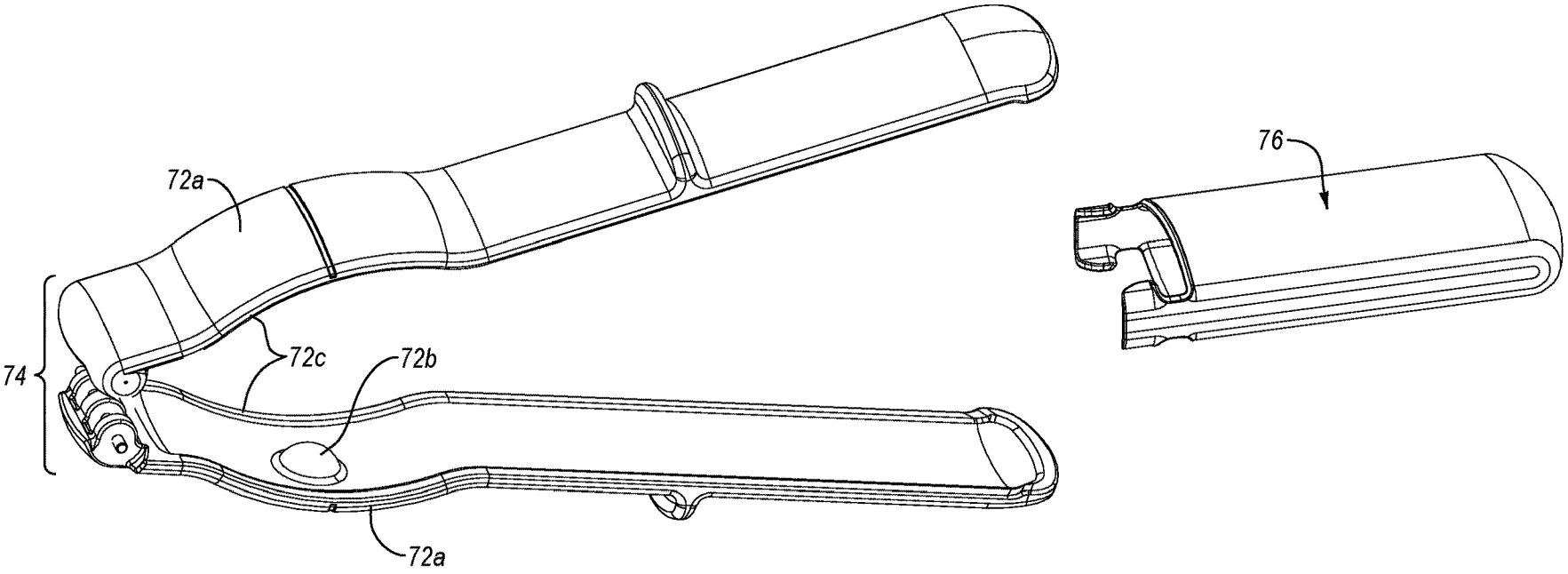
FIG. 14*b* is a side partial exploded view of the muscle exercise device of FIG. 14*a*.
Figure 14C:
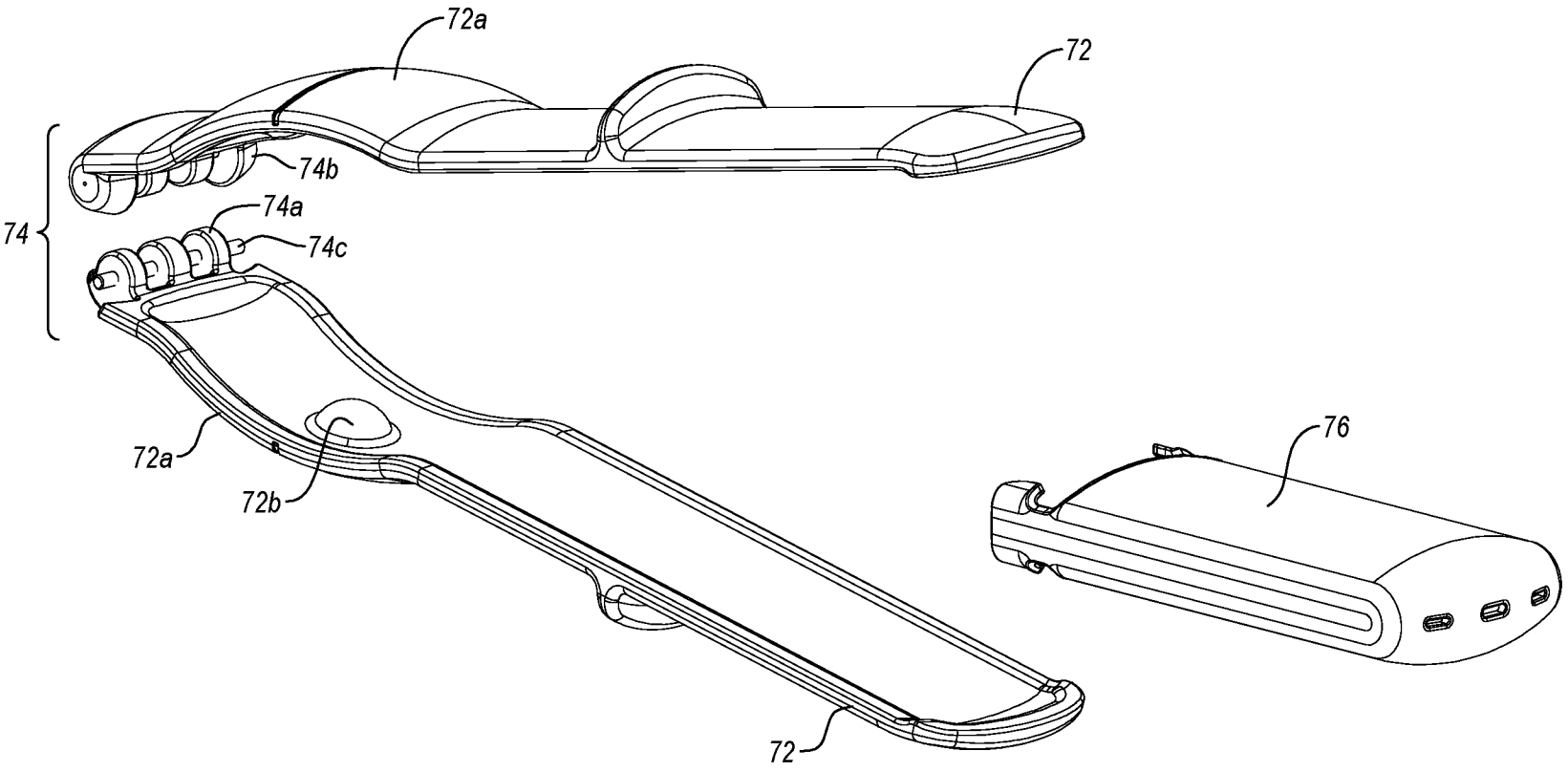
FIG. 14*c* is a perspective partial exploded view of the muscle exercise device of FIG. 14*a*.

As best shown in FIGS. 14*b* and 14*c*, each of the arms 72 may define, or otherwise include, a respective portion 74*a* and 74*b* of the hinge 74, and the portions 74*a* and 74*b* can be connected to each other by a pin 74*c* that passes through holes respectively defined by portions 74*a* and 74*b*. Thus connected, the arms 72 are free to rotate relative to each other when not constrained, such as by the cover 76. In some instances, the rotational range of motion of one of the arms 72 relative to the other arm 72 is in the range of about 270 degrees to about 360 degrees when the resistance element 78 is not present, although other ranges of motion, larger or smaller than the aforementioned range, can be defined and implemented.

As well, one or both of the arms 72 may further include a concave portion 72*a* such that when respective concave portions 72*a* of the arms 72 are disposed generally opposite each other, a recess 73 of variable size is cooperatively defined by the oppositely disposed concave portions 72*a*. That is, the size of the recess 73 can be adjusted by moving one or both of the arms 72 relative to the other arm 72.

Figure 14D:
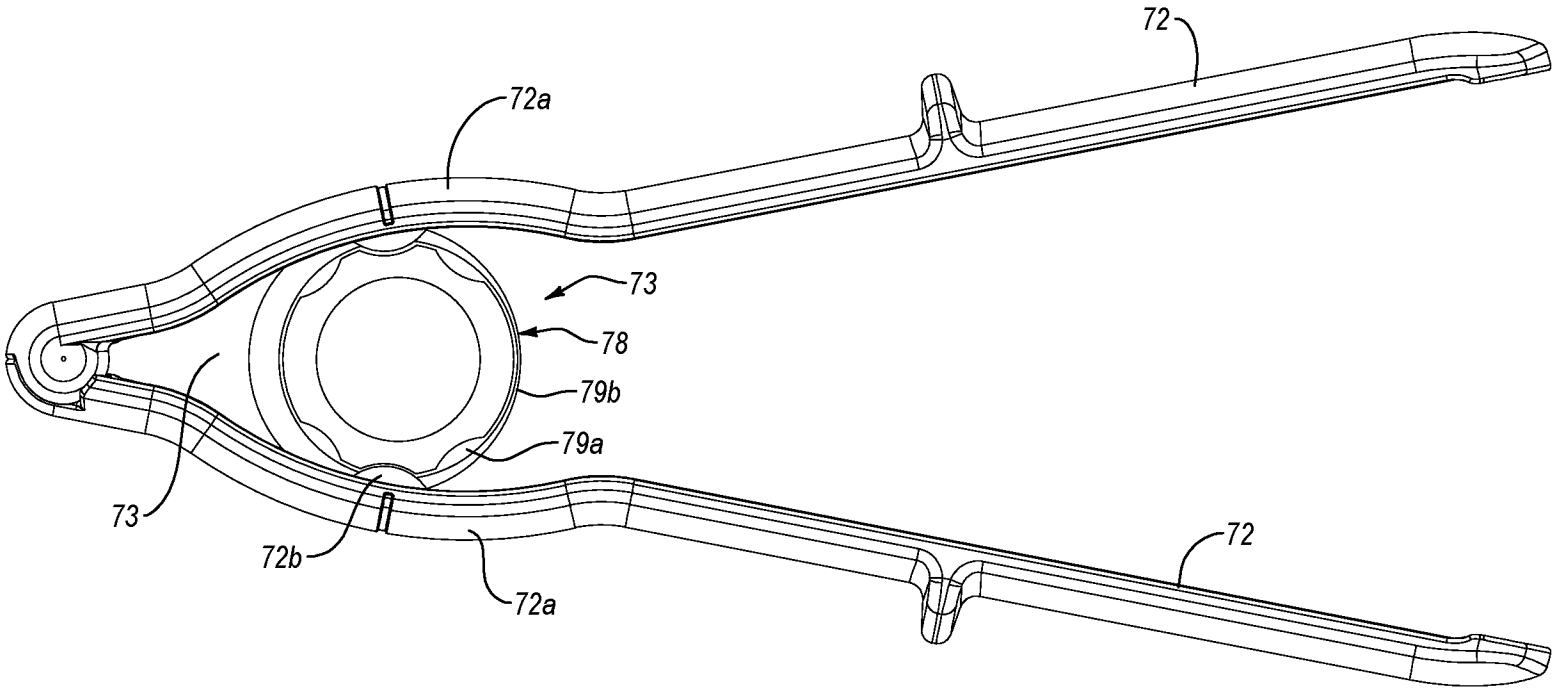
FIG. 14*d* is a section view of the muscle exercise device of FIG. 14*a*, indicating the interface between the arms and a resistance element.
Figure 15A:
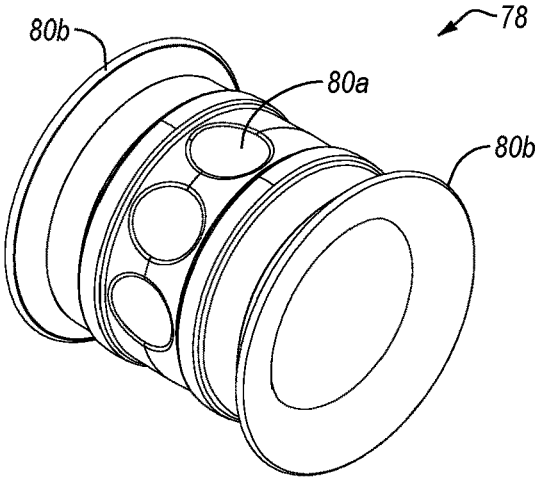
FIG. 15*a* is a perspective view of the example resistance element of the muscle exercise device of FIG. 14*a*.
Figure 15B:
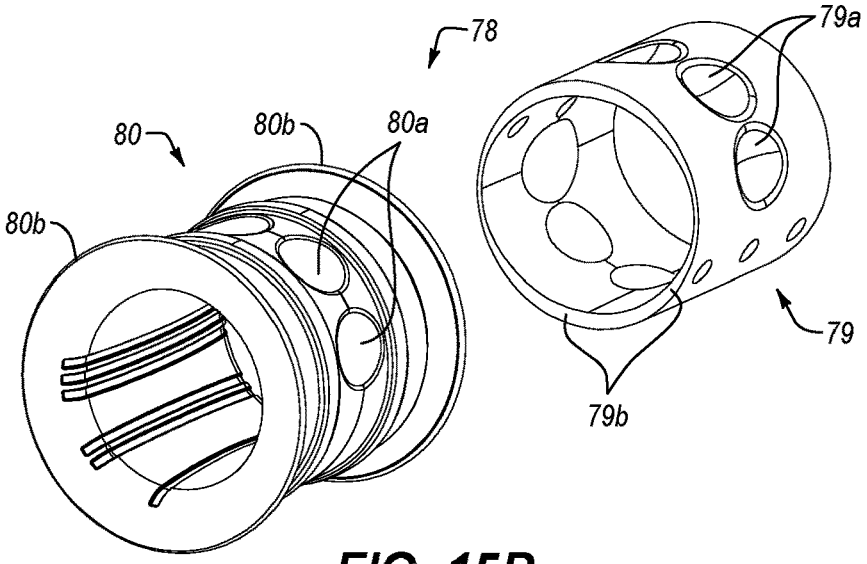
FIG. 15*b* is an exploded view of the resistance element of FIG. 15*a*.
Figure 15C:
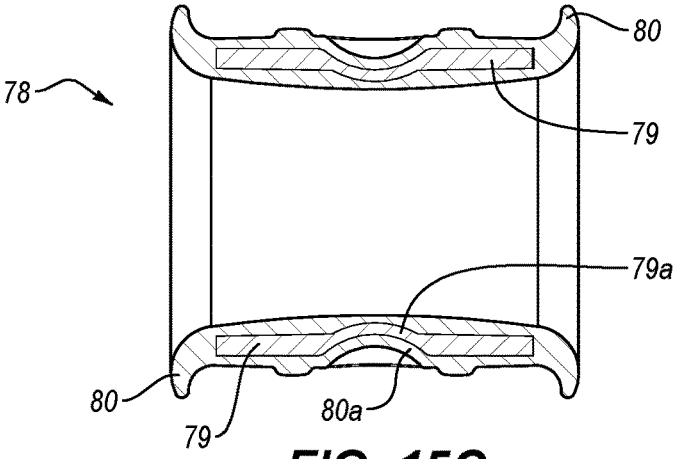
FIG. 15*c* is a section view of the resistance element of FIG. 15*a*.

With continued attention to FIGS. 14*a*, 14*b* and 14*d* in particular, and directing attention now to FIGS. 15*a*-15*c* as well, further details are provided concerning the resistance element 78. In general, and as best shown in FIGS. 15*b* and 15*c*, the resistance element 78 can have a dual element overmold configuration, although that is not required in every embodiment.

In more detail, the resistance element 78 includes an inner core element 79 that is overmolded by an outer core element 80. The inner core element 79, which in this example is the primary source of resistance offered by the resistance element 78, may be made of a material that is relatively stiffer and harder than the material of the outer core element 80. Thus, in one example embodiment, the inner core element 79 includes, or consists of, polypropylene (PP) and the overmolded outer core element 80 includes, or consists of, a thermoplastic polymer (TPE).

This combination provides relatively good resistance properties by way of the inner core element 79, while the outer core element 80 provides a relatively soft interface or touch with the anatomy of the user. The outer core element 80 can include indicia, examples of which are disclosed herein, that indicate to the user the resistance, or range of resistances, offered by the resistance element 78. Moreover, the overmold configuration of the inner core element 79 and outer core element 80 may help to prevent movement of one of those elements relative to the other when the resistance element 78 is in use.

With continued reference to FIGS. 15*a*-15*c*, the outer core element 80 of the resistance element 78 may include one or more recesses 80*a* or other structures that are configured and arranged to releasably engage corresponding protrusions 72*b* or other structures of one or both of the arms 72. The recesses 80*a* may cooperate with the protrusions 72*b* help to retain the outer core element 80 and, thus, the resistance element 78, in position between the arms 72 when the muscle exercise apparatus 70 is in use. Retention of the resistance element 78 between the arms 72 can be further aided by flanges 80*b* on opposing sides of the outer core element 80 of the resistance element 78. More particularly, and as shown in FIG. 14*a* for example, the flanges 80*b* can partially, or completely in some embodiments, extend outside the outer edges 72*c* of the concave portions of the arms 72, such that significant lateral movement of the resistance element 78 relative to the recess 73 is substantially, or even completely, prevented when the muscle exercise apparatus 70 is in use.

It should be noted that the protrusions 72*b* and recesses 80*a* are examples of complementary structures configured to releasably engage each other. However, other complementary engagement structures of different physical configurations can alternatively be employed, and the scope of the invention is not limited to the disclosed examples. Thus, in one alternative embodiment, a resistance element can include protrusions that engage recesses of one or two arms of a muscle exercise device.

It will also be appreciated that the protrusions 72*b*/recesses 80*a*, and ribs 58*c*/slots 52*c* are example structural implementation of a means for releasably retaining a resistance element between the arms of a muscle exercise device. As noted herein, such means can, among other things, substantially prevent rotation of a resistance element relative to one or both arms of a muscle exercise device.

With particular reference now to the inner core element 79 and FIGS. 15*b* and 15*c*, the inner core element 79 may include a plurality of recesses 79*a* into each of which a portion of recess 80*a* protrudes. This configuration may help to prevent movement of the inner core element 79 relative to the outer core element 80 when the resistance element 78 is in use. As well, such a configuration may help to ensure efficient transmission of the resistance force from the inner core element 79 to the outer core element 80 and to the user.

As further indicated in FIG. 15*b* in particular, the wall 79*b* thickness of the inner core element 79 can vary, although in other embodiments, the wall 79*b* thickness may be substantially consistent. In the particular example of FIG. 15*b*, the wall 79*b* thickness can be relatively greater in the area where the recesses 79*a* are located. As noted above, the location of the recesses 79*a* is such that the recesses 80*a* of the outer core element 80 interface with the recesses 79*a*. Thus, and with reference now to FIGS. 14*b* and 14*d* as well, it will be apparent that the relatively thicker wall 79*b* portions of the inner core element 79 can be located at or near a location where the force exerted on the resistance element 78 by the arms 72 is at a maximum.

As can also be seen from FIG. 14*d* in particular, and in view of the variations in wall 79*b* thickness indicated in FIG. 15*b*, the resistance offered by the resistance element 78 can be varied by rotating the resistance element 78 such that relatively thicker or thinner wall 79*b* portions are located at or near the protrusions 72*b* of the arms 72. Thus, the resistance offered by the resistance element 78 may be at a maximum when the resistance element 78 is positioned in the arms 72 as shown in FIG. 14*d*, and the resistance offered by the resistance element 78 can be reduced, relative to that maximum, by rotating the resistance element 78 such that a different one of the recesses 80*a* engages the protrusions 72*b*.

Figure 16:
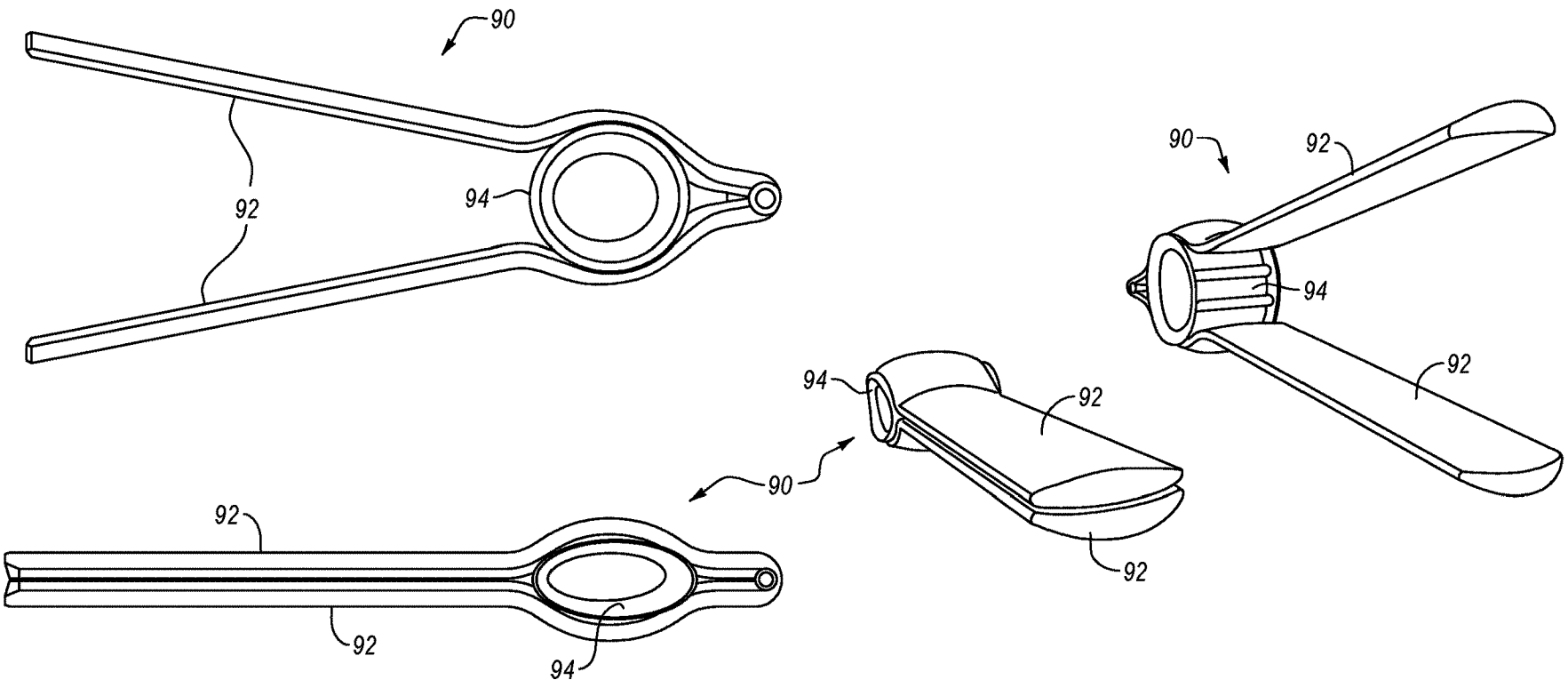
FIG. 16 includes a variety of views of another embodiment of a muscle exercise device.
Figure 16C:
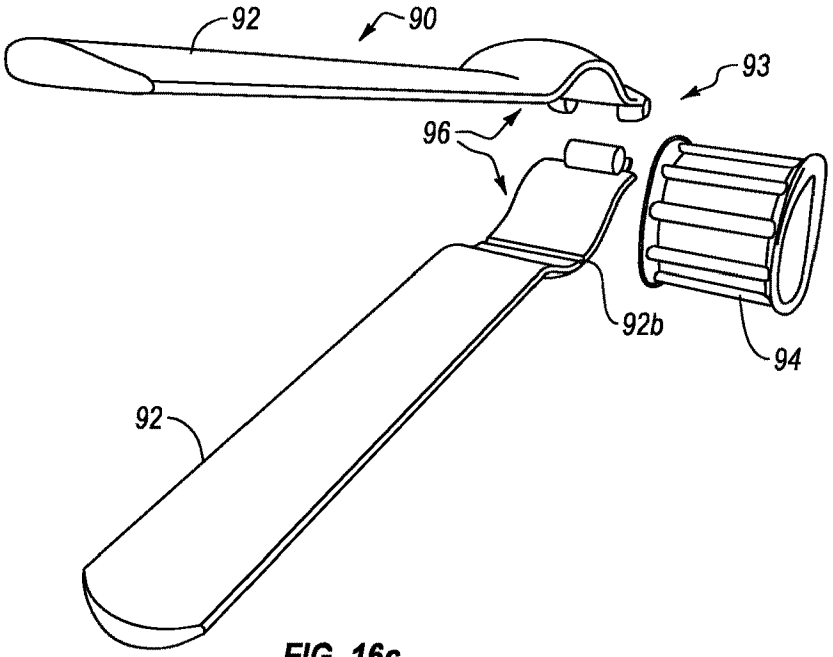
FIG. 16*c* is an exploded view of the device of FIG. 16*a*.

With reference next to FIGS. 16-16*c*, details are provided concerning an alternative embodiment of the muscle exercise device, denoted generally at 90. The alternative embodiment may be similar, or identical, to the embodiment of FIGS. 14*a*-15*c*, except as noted below. Accordingly, the discussion below will be limited to selected aspects of the muscle exercise device 90. It should be noted that as is true in the case of the other embodiments disclosed herein, aspects of the embodiment of FIGS. 16*a*-16*c* can be combined with elements of one or more other disclosed embodiments to define still further embodiments.

As indicated in FIGS. 16-16*c*, and similar to other embodiments disclosed herein, the muscle exercise device 90 includes a pair of arms 92 that define respective portions of a hinge 93 that enables the arms 92 to move relative to each other about an axis defined by the hinge 93. The hinge 93 can be configured so that the two arms 92 snap together to form the hinge, or the hinge 93 can include a pin (not shown) that holds the two arms 92 together.

One or both of the arms 92 can include an alignment mark 92*a* and/or other indicia that provides a guide for the user when positioning a resistance element 94 relative to the arms 92. In particular, the resistance element 94 can be removably positioned within a recess 96 cooperatively defined by the arms 92. The resistance element 94 may include force markings 94*a* and/or other indicia that indicate the amount of resistance provided by the resistance element 94 when a particular force marking 94*a* is aligned with the alignment mark 92*a*.

Figure 16B:
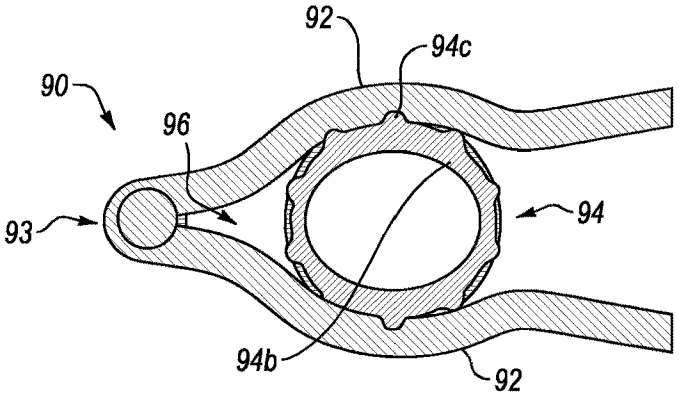
FIG. 16*b* is a partial side view of the device of FIG. 16*a*.
Figure 16A:
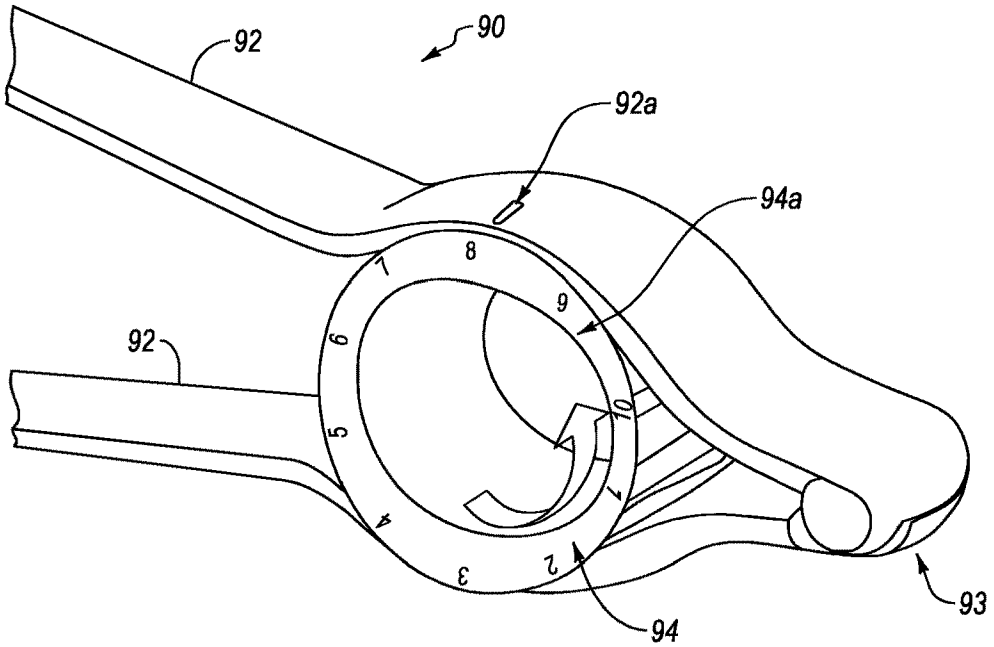
FIG. 16*a* is a side perspective view of another embodiment of a muscle exercise device.

As best shown in FIG. 16*b*, the variation in resistance offered by the resistance element 94 can be achieved, for example, by constructing the resistance element 94 so that the wall thickness 94*b* varies at different locations about the diameter of the resistance element 94. Thus, in the particular example of FIG. 16*b*, the relatively thinner wall portions of the resistance element 94 are subjected to compression when the arms 92 are moved together. The resistance offered by the resistance element 94 in this configuration is relatively less than would be the case if the resistance element 94 were repositioned in such a way that the relatively thicker wall portions of the resistance element 94 were subjected to compression when the arms 92 are moved together, that is, by rotating the resistance element 94 so that the relatively thinner wall portions are in contact with the arms 92.

With continued reference to FIG. 16*b*, the resistance element 94 can include one or more axial ribs 94*c* configured to be positioned in a corresponding slot 92*b* defined by an arm 92 when the resistance element 94 is positioned between the arms 92. This configuration can help to prevent rotation of the resistance element 94 during use and, as such, can provide assurance to the user that a particular resistance is being maintained during exercise.

With reference next to FIGS. 17*a*-17*e*, details are provided concerning an alternative embodiment of the muscle exercise device, denoted generally at 100. This embodiment includes a pair of arms 102, which may be plastic for example, configured for movement relative to each other by way of a configuration in which a first element 102*a* rotates within a second element 102*b*.

The muscle exercise device 100 further includes resistance element 104, which can be made of rubber such as silicone rubber, configured to releasable engage each of the arms 102. In the illustrated example, each end of the resistance element 104 includes a laterally extending arm 104*a*, each end of which is configured to be received within a respective one of a pair of recesses 102*c* defined by the arms 102. Thus configured and positioned, the resistance element 104 tends to resist movement of the arms 102 toward each other. The amount of resistance offered by the resistance element 104 can be varied by moving the bar 104*a* to a different pair of recesses 102*c* on one, or both, of the arms 102. In this regard, the resistance element 104 is provided with a pair of handles 104*b* that enable a user to readily remove the bar 104*a* from a set of recesses 102*c*.

Figure 17B:
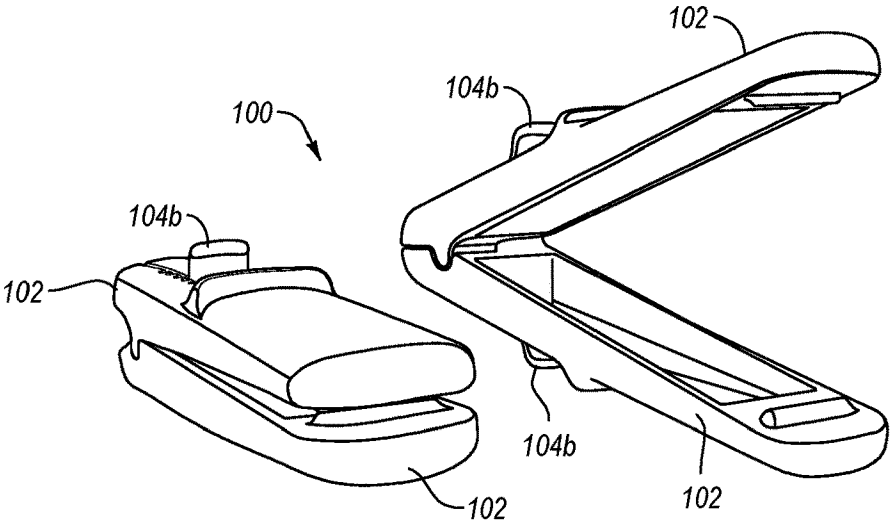
FIG. 17*b* is a perspective view of the device of FIG. 17*a*.
Figure 17A:
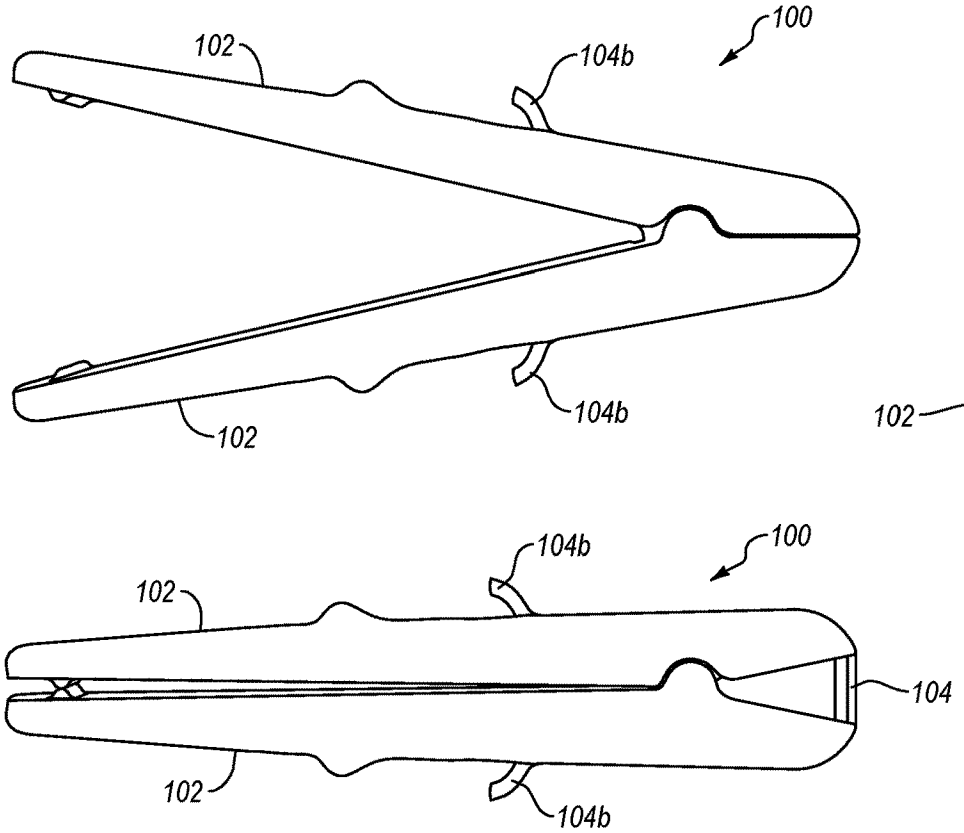
FIG. 17*a* is a side view of another embodiment of a muscle exercise device, indicating the device in open and closed orientations.
Figure 17D:
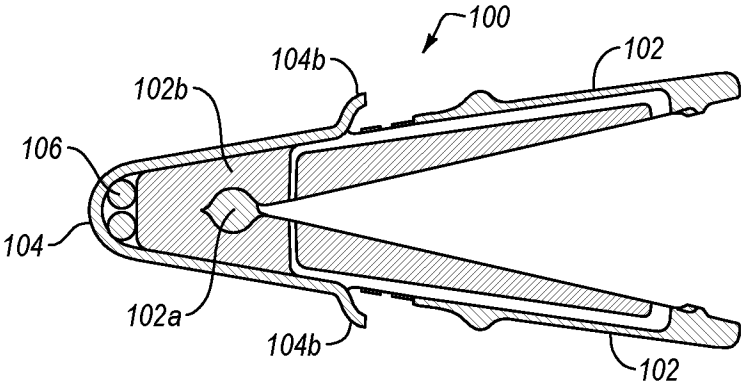
FIG. 17*d* is a section view of the device of FIG. 17*a*.
Figure 17E:
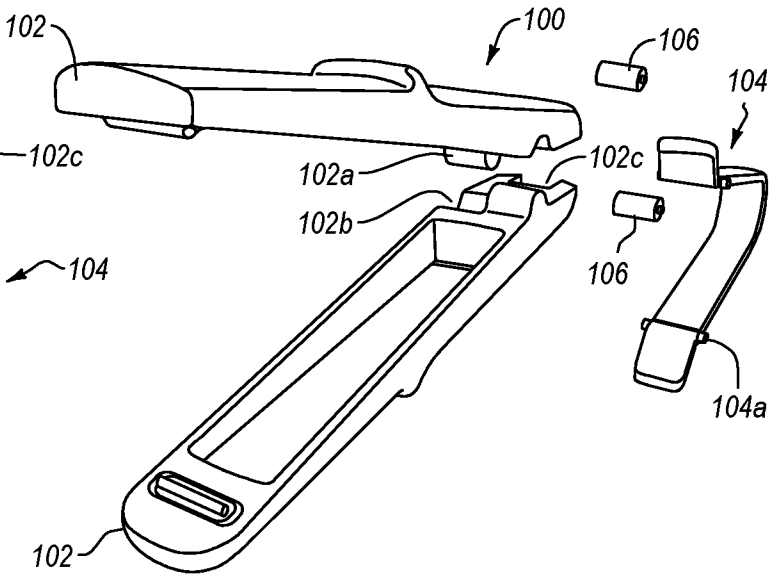
FIG. 17*e* is an exploded view of the device of FIG. 17*a*.
Figure 17C:
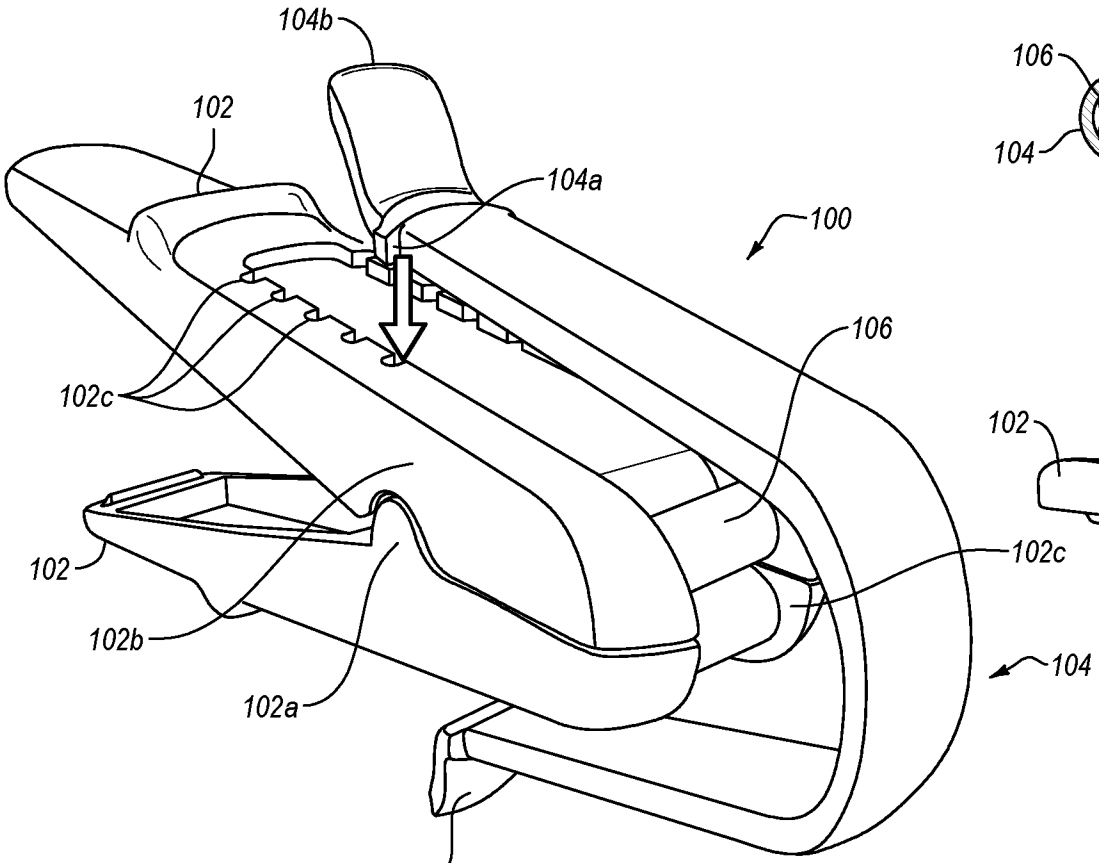
FIG. 17*c* is a partial exploded view of the device of FIG. 17*a*.

As best shown in FIGS. 17*c* and 17*d*, the muscle exercise device 100 may further include one or more rollers 106, which may be plastic for example, positioned underneath the resistance element 104. The rollers 106 can be removably received in recesses 102*c* defined by the arms 102. The recesses 102*c* are configured so that the rollers 106 can rotate, such as in response to deformation of the resistance element 104, but are retained in position unless or until the arms 102 are detached from each other.

With continued reference to FIGS. 17*c* and 17*d*, the rollers 106 are each positioned for contact with a portion of the resistance element 104. Because the rollers may rotate as the resistance element 104 is elastically deformed during use, the rollers 106 may thus help to ensure that a consistent force is applied to the resistance element 104 by the arms 102 as the arms 102 move toward and/or away from each other.

Figure 18B:
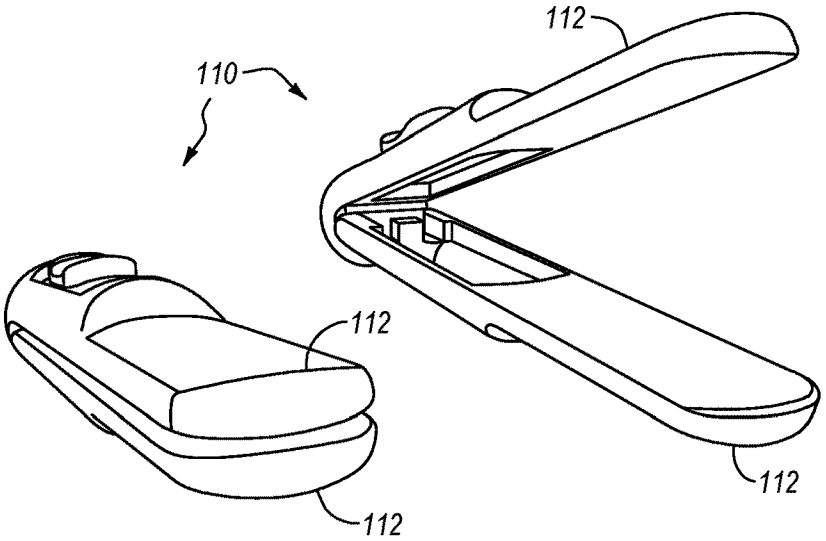
FIG. 18*b* is a perspective view of the device of FIG. 18*a*.
Figure 18A:
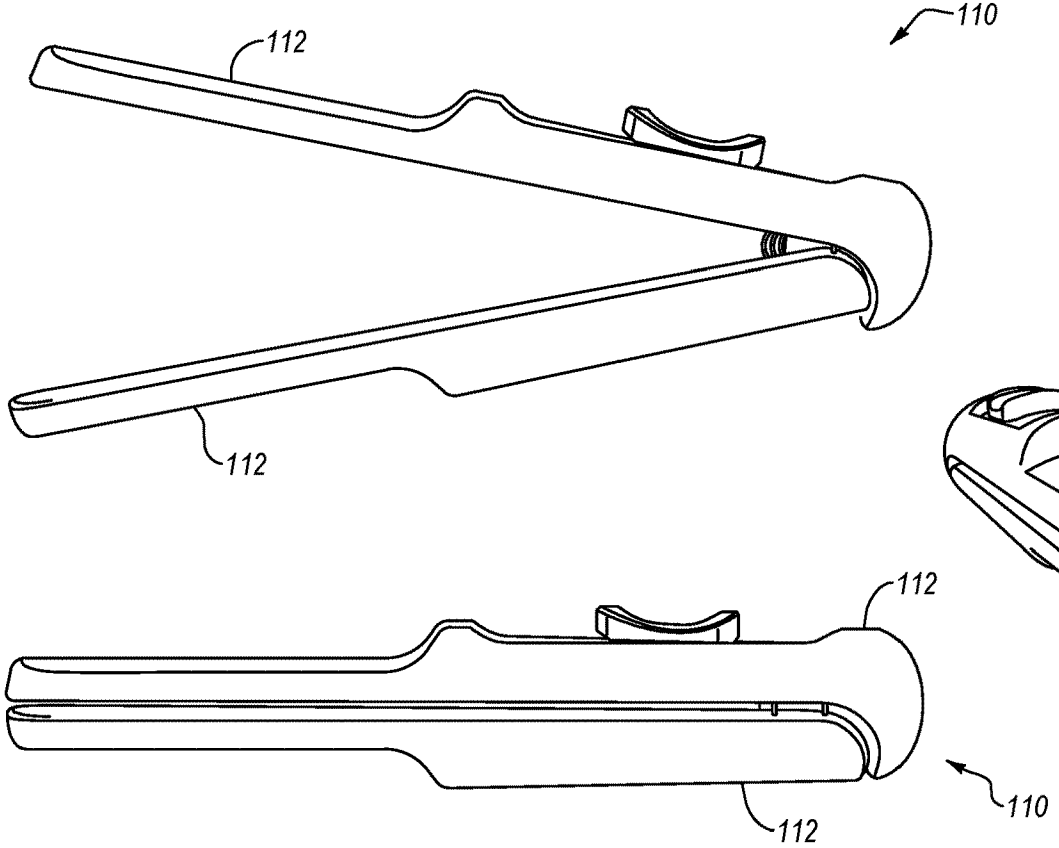
FIG. 18*a* is a side view of another embodiment of a muscle exercise device, indicating the device in open and closed orientations.
Figure 18D:
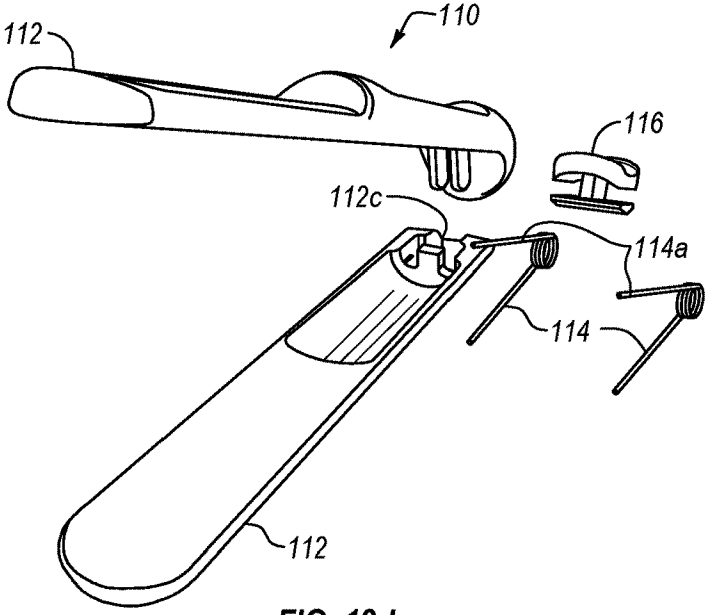
FIG. 18*d* is an exploded view of the device of FIG. 18*a*.
Figure 18E:
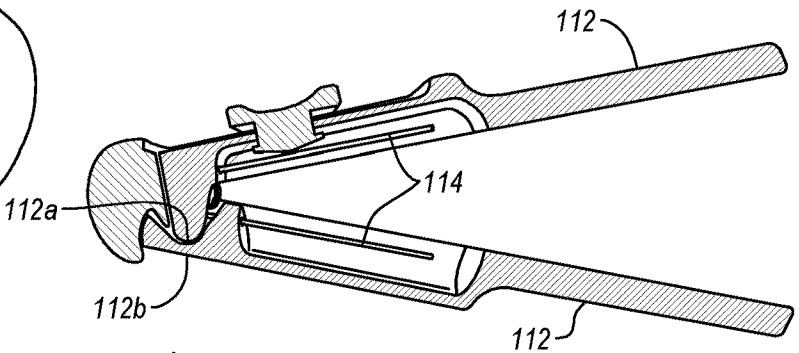
FIG. 18*e* is a section view of the device of FIG. 18*a*.

With reference finally to FIGS. 18*a*-18*e*, details are provided concerning an alternative embodiment of the muscle exercise device, denoted generally at 110. This embodiment includes a pair of arms 112, which may be plastic for example, configured for movement relative to each other by way of a configuration in which a first element 112*a* rotates within a second element 112*b*. The first element 112*a* can take the form of a protrusion, while the second element 112*b* can take the form of a recess that receives the first element 112*a*. As best shown in FIG. 18*e*, the elements 112*a* and/or 112*b* can be configured to limit a rotational range of motion of element 112*a* relative to element 112*b*. By limiting the rotational range of motion in this way, the arms 112 may be prevented from separating from each other. In some embodiments, the elements 112*a* and 112*b* are connected to each other by way of a pin (not shown), although other elements and configurations could be used. For example, element 112*a* can be snap fit into element 112*b*.

As further indicated in 18*b*-18*e*, one or more resilient elements 114, such as metal torsion springs for example, can be provided that serve to bias the arms 112 apart from each other, such as toward the position indicated in FIG. 18*e*. The resilient elements 114 are received in a recess 112*c* defined by one or both of the arms 112. Thus configured and arranged, the resilient elements 114 tend to resist movement of the arms 112 toward each other, such as would occur during exercise. The resilient elements 114 can be connected to one or both of the arms 112, although that is not required.

Figure 18C:
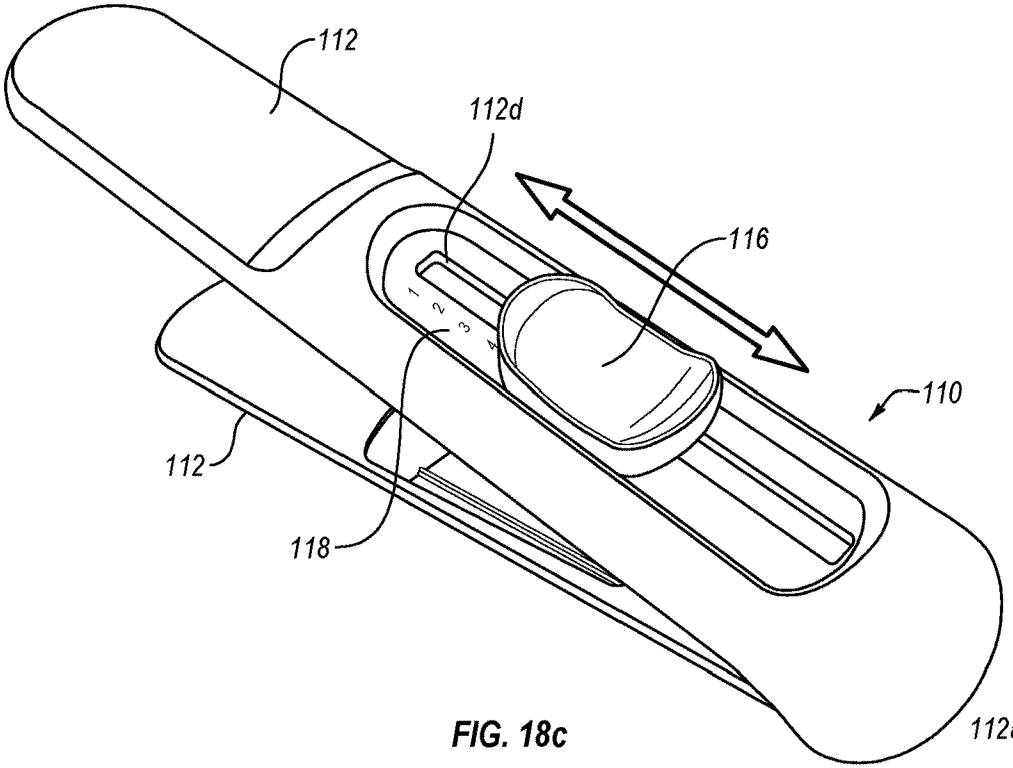
FIG. 18*c* is a perspective view of the device of FIG. 18*a*.

With attention to FIGS. 18*c* and 18*d*, a mechanism can be provided for adjusting the biasing force exerted by the resilient elements 114. In particular, a slider 116 is provided that is configured to move along a slot 112*d* defined by one of the arms 112. As best shown in FIG. 18*e*, a portion of the slider 116 extends downward through the slot 112*d* so as to contact first arms 114*a* of the resilient elements 114. Indicia 118, such as numbers for example, are provided proximate the slot 112*d* indicate to the user a relative resistance force that corresponds with the position of the slider 116. As such, the user can modify the resistance force offered by the resilient elements 114 by changing the position of the slider 116 along the slot 112*d*.

In more detail, it was noted above that the slider 116 contacts the arms 114*a* of the resilient elements 114. Thus, when the slider 116 is positioned in the rightmost position permitted by the slot 112*d* in FIG. 18*e*, movement of the upper arm 112, carrying the slider 116, toward the lower arm 112 causes a deflection of the arm 114*a* at a point near the free end of the arm 114*a*. On the other hand, when the slider 116 is positioned in the leftmost position permitted by the slot 112*d* in FIG. 18*e*, movement of the upper arm 112, carrying the slider 116, toward the lower arm 112 causes a deflection of the arm 114*a* at a point relatively more distant from the free end of the arm 114*a*. Because the deflection of the arm 114*a* at this more distant location from the free end of the arm 114*a*, that is, a location relatively closer to the point where the arms 112 contact each other, is relatively more difficult to impose than deflection of the arm 114*a* near the free end of the arm 114*a*, the resistance force offered by the muscle exercise device 110 is relatively greater, referring again to FIG. 18*e*, when the slider 116 is in the leftmost position than when the slider 116 is in the rightmost position.

Finally, as noted elsewhere herein, embodiments of the invention can be configured to include a relatively small number of parts. This approach can ease manufacturing, and also make the device easier to use. Thus, in some example embodiments, a muscle exercise device is provided that consists of four parts, namely, a first arm, a second arm, a hinge joining the first arm and the second arm to each other, and a resistance element. In another example embodiment, a muscle exercise device is provided that consists of five parts, namely, a first arm, a second arm, a hinge joining the first arm and the second arm to each other, a lock to lock the first arm and second arm in position relative to each other, and a resistance element.

C. Example Embodiments Including Bluetooth Function

In general, any of the disclosed embodiments of the muscle exercise device can implement various functionalities using Bluetooth®, and/or comparable, communication functionality, as discussed below. In some embodiments, near-field communication functions and devices are employed. By way of brief illustration, the muscle exercise device can include a Bluetooth, or other, electronic transmitter, which can be removably positioned in a fluid tight compartment in an arm of the muscle exercise device, that is able to transmit data to, and receive data from, by way of an antenna for example, one or more external systems and devices.

One example of such a system and device is a smartphone, or other electronic device such as a notepad, tablet or laptop computer for example, that includes an app that can transmit data to, and/or receive data from, the Bluetooth transmitter, and display the transmitted/received data either alone, or in conjunction with other information. Displayed information may include, for example, text, and various graphical elements such as illustrations, diagrams, and calendars. Some example screenshots illustrating various functions, information, and displays of an example of such an app are disclosed in Appendix A hereto.

The app can receive user input by way of any type of user interface such as a Graphical User Interface (GUI) for example, and/or the app can receive audio input by way of a speaker, by way of a camera, and/or tactile and haptic input such as by way of a touch sensitive smartphone screen for example. The app can display text, graphics, video, combinations of these, and other media. As well, the app can operate in conjunction with smartphone circuitry, for example, to generate and present to a user, any combination of text, graphics, video, and audio. Data presented to the user can be informational in nature, and may also include audible and/or visible information, prompts to take an action, which may be presented in audio, video, or tactile form, for example. As well, the app can include a clock, counter for counting arm movements, and count up or countdown timer. Any data received and/or generated by the app can be retrievably stored locally on the smartphone or other device, and/or can be uploaded wirelessly, and/or by way of a hardwire connection, to another device, a website, and/or a cloud data storage site, for example.

Data received by the app from the muscle exercise device can be generated by the muscle exercise device in any of a variety of ways. For example, the muscle exercise device may include elements such as accelerometers, transducers, motion sensors, position sensing devices, and orientation sensing devices. These devices, individually and/or collectively, can sense acceleration, movement, position, and orientation of one or more portions of the muscle exercise device, such as the arm(s). This information can be used by one or more processors to determine, for example, that one arm has moved relative to the other arm, the number of times that one arm has moved relative to the other, the number of times, or repetitions, that the arm(s) have moved during a particular timeframe, the speed of the motion of an arm relative to the other arm, the range of motion of one arm relative to the other arm, the total time that the muscle exercise device has been in use. The movements of the arms can be correlated with various performance standards, examples of which are disclosed in Appendix A.

With attention now to FIGS. 19-24, details are provided concerning an example embodiment of a muscle exercise device 200 that includes Bluetooth, or similar, functionality. Except as may be noted below, the muscle exercise device 200 may be similar, or identical, to any other embodiments of a muscle exercise device disclosed herein. Thus, the following discussion is directed primarily to selected differences between the muscle exercise device 200 and the other disclosed embodiments.

Figure 19:
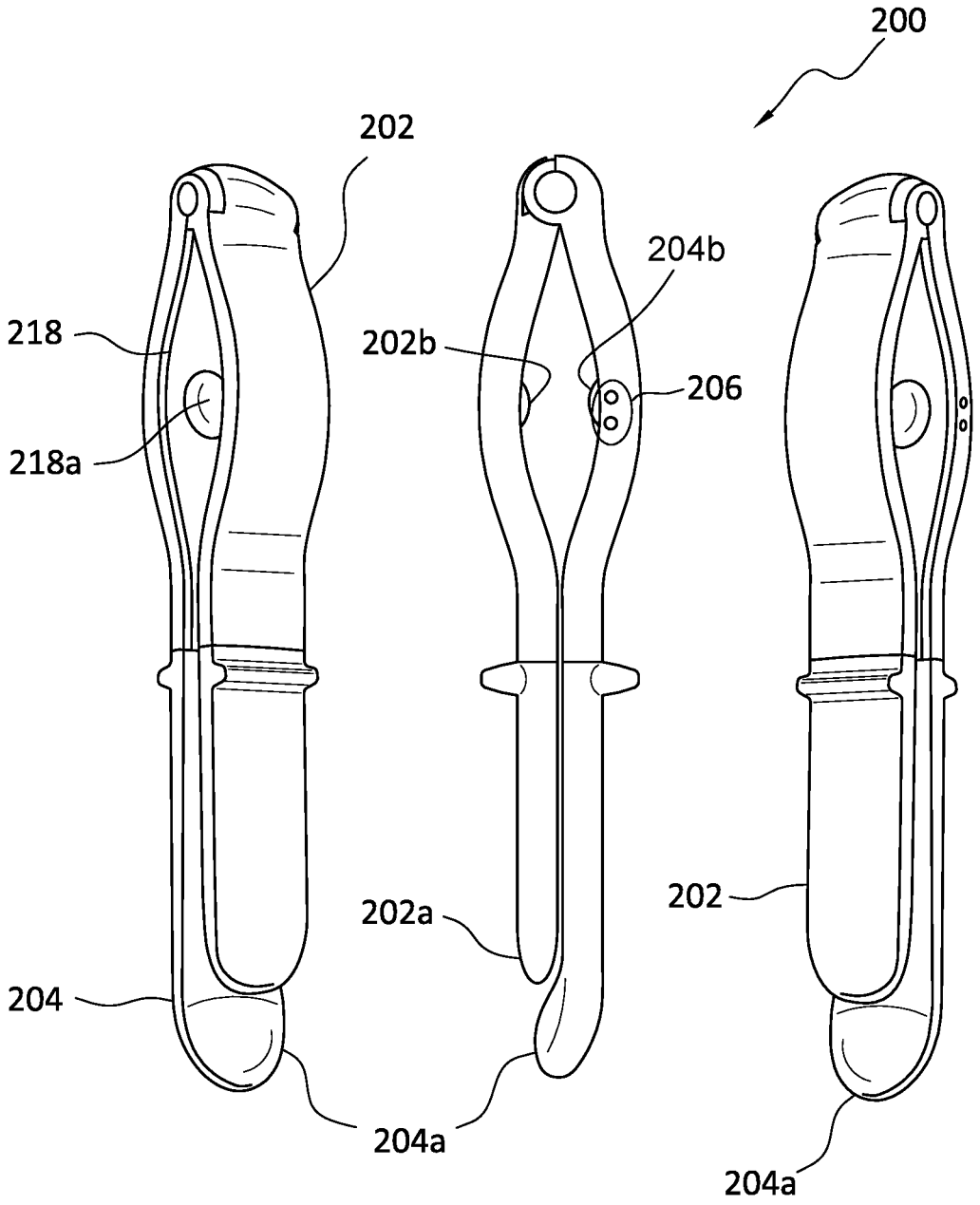
FIGS. 19-24 are directed to another embodiment of a muscle exercise device.

As shown in FIG. 19 for example, the muscle exercise device 200 may include arms 202 and 204 rotatably connected to each other. While not specifically illustrated, a spring (see, e.g., Appendix B), which can be made of stainless steel or other material(s), may be provided that connects to, or otherwise engages, the arms 202 and 204, and biases the arms 202 toward, or away from, each other. One example implementation of such a spring may have a resistance force F of about 250 grams at a certain deflection, such as a maximum deflection (where F=kX, and k is the spring constant, and X is the deflection distance). The arm 204 may be longer than the arm 202 and may include a bulbous, inwardly extending, portion 204*a*. The portion 204*a* may be configured and arranged such that, when viewed from the side, the portion 204*a* does not extend beyond an outer surface 202*a* of the arm 202.

Of course, variations to the illustrated configurations disclosed herein are possible. For example, in other embodiments, the bulbous portion 204*a* can be omitted and the configuration of the end of the arm 204 can be similar, or identical, to the configuration of the end of the arm 202. As another example, in some embodiments, the arms 202 and 204 may be the same length, or substantially the same length (such as having respective lengths within about 5 percent of the other length). Any or all of these, and other disclosed variations, can be combined together in a single embodiment.

One or the other of the arms 202 or 204 may include an electrical charging connection 206 configured to interface with a charging cord (not shown). The charging cord can include, for example, a USB interface that can be plugged into a power source. The electrical charging connection 206 can be provided in whichever of the two arms 202 and 204 houses the wireless transmitter and related electronics and power source. In the illustrated example, the wireless transmitter and related electronics and power source are housed in arm 204, while in other embodiments, those components can alternatively be housed in arm 202. In still other embodiments, the components can be split so that some are housed in arm 202 while others are housed in arm 204.

In some embodiments, the electrical charging connection 206 can be omitted. Instead, such embodiments are configured to enable wireless inductive charging of a battery or other power source housed in one of the arms 202 or 204. here a battery, examples of which are discussed below, is used as the power source, the battery can be a rechargeable battery, or a single use battery, that is, a non-rechargeable battery. In some cases, multiple batteries, re-chargeable or non-rechargeable, can be used. Where a non-rechargeable battery is employed, the electrical charging connection 206 may be omitted.

Figure 20:
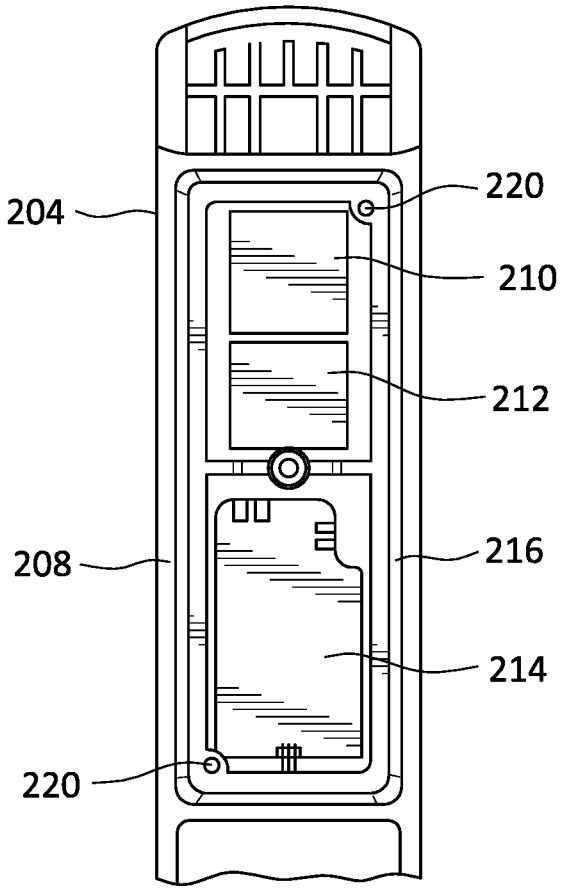
Figure 21:
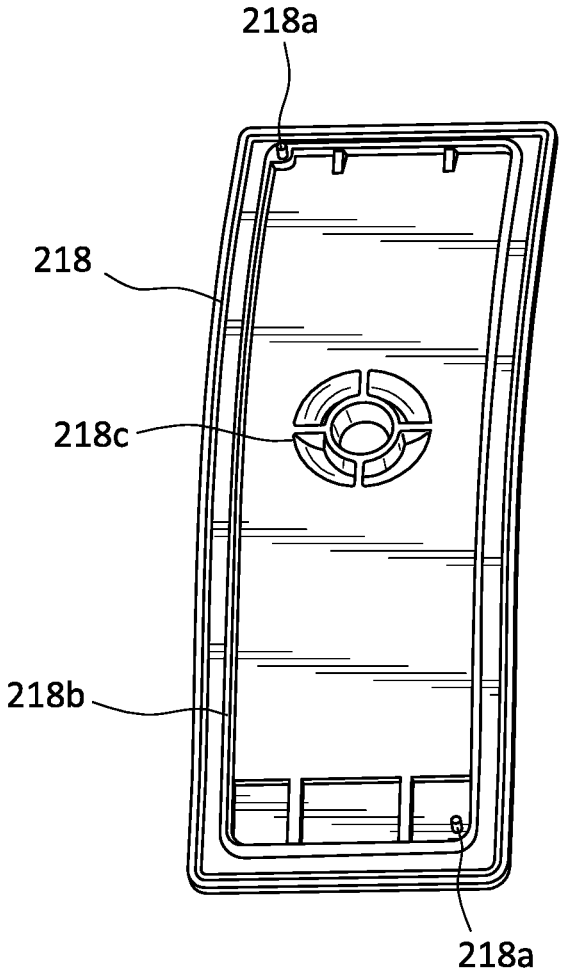

With continued attention to FIG. 19, and directing attention now to FIGS. 20 and 21, further details are provided concerning the construction of arm 204, particularly as it relates to the housing of a power source and various other components. As shown, the arm 204 defines a cavity 208 within which are disposed a power source 210, such as a lithium ion battery for example, a Bluetooth chip 212, and various other circuitry 214. Among other things, such circuitry 214 can include, but is not limited to, printed circuit boards (PCB), an antenna, and elements such as accelerometers, transducers, proximity sensor or other distance sensing device, motion sensors, position sensing devices, and orientation sensing devices. All of the aforementioned components can be powered by the power source 210, and can interface with the Bluetooth chip 212. The circuitry 214 may include application specific integrated circuits (ASIC), and field programmable gate arrays (FPGA), programmed/programmable to implement any of the functions disclosed herein with respect to the muscle exercise device 200 and the associated app.

As shown in FIG. 20, a sealing element 216 can be provided that extends around the perimeter of the cavity 208. The sealing element, which may have a circular cross-section, although that is not required, may be made of rubber, silicone, or similar materials. In general, the sealing element 216 cooperates with a lid 218 to provide a fluid tight seal around the cavity 208. The lid 218 can be made of the same material as the arm 204, although that is not necessarily required. The lid 218 may include one or more guide poles 218*a* configured to be removably received in corresponding guide recesses 220 of the arm 204. As well, the lid 218 includes a ridge 218*b* configured to align with, and compress, the sealing element 216 when the lid 218 is positioned on the arm 204. The lid 218 can be removably retained on the arm 202 by any suitable locking or retention mechanism. In the embodiment illustrated in FIGS. 20 and 21, the lid 218 is removably retained on the arm 202 by way of a retention mechanism 218*c* that includes snap-fit configuration.

In the example embodiment of FIGS. 20 and 21, the cavity 208 is located at an inner portion of the arm 204. As such, the lid 218 can include, on its exterior surface, a guide pole 218*a* configured to engage a resistance element, examples of which are disclosed elsewhere herein. Examples of guide poles 218*a* are disclosed elsewhere herein (see, e.g., 72*b*).

Figure 22:
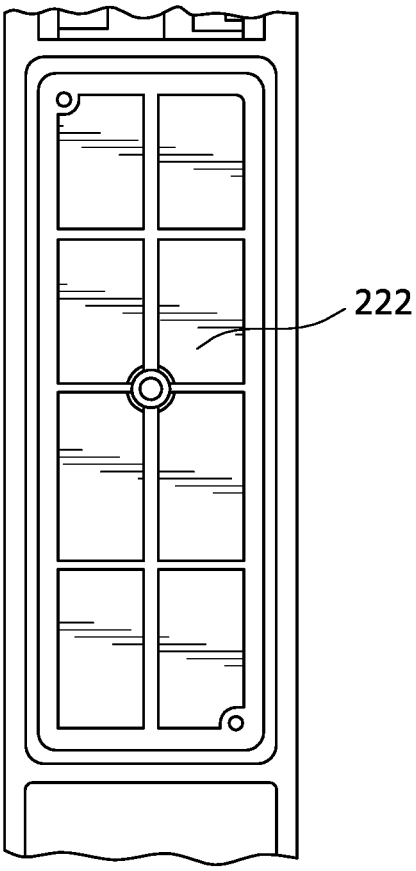

Turning now to FIG. 22, it can be seen that arm 202 may also include a cavity, such as cavity 222 for example. The lid (not shown) for the cavity 222 can be similar, or identical, to the lid 218. This configuration may be employed when the muscle exercise device 200 includes a proximity sensor that senses a distance between arms 202 and 204, and changes in that distance. One embodiment of the proximity sensor is a single element configuration that includes a transmitter disposed in one arm 202/204 that transmits a signal to, and receives a corresponding reflected signal from, the other arm 202/204. Another embodiment of the proximity sensor includes two elements, namely, a transmitting element, and a reflecting element. In this configuration, the transmitting element is positioned in one of the arms 202 or 204, and the reflecting element is positioned in the other of the arms 202 or 204. More specifically, one element of the proximity sensor can be positioned in the cavity 208 of arm 204, while the other element of the proximity sensor can be positioned in the cavity 222 of arm 202. The cavity 222 may be associated with sealing element, lid, guide poles, guide holes, and ridge, that are similar or identical, respectively, to the configuration of cavity 208 and its associated sealing element 216, lid 218, guide poles 218*a*, guide holes 220, and ridge 218*b*.

With continued reference to FIGS. 20-22, it will be appreciated that any number of variations to the disclosed configurations are possible, and any of such variations, and others disclosed herein, can be combined in a single embodiment. For example, while both of the arms 202 and 204 are indicated as having respective cavities 208 and 222, along with corresponding respective lid 218 (lid for cavity 222 not shown), some embodiments of the muscle exercise device 200 may omit one of the cavities/lids, such that only one cavity/lid combination, in only one of the arms 202/204, is provided. In such an embodiment, all of the electronics, including those discussed herein, and the power source may be situated in just one or the other of the arms 202/204.

Figure 23:
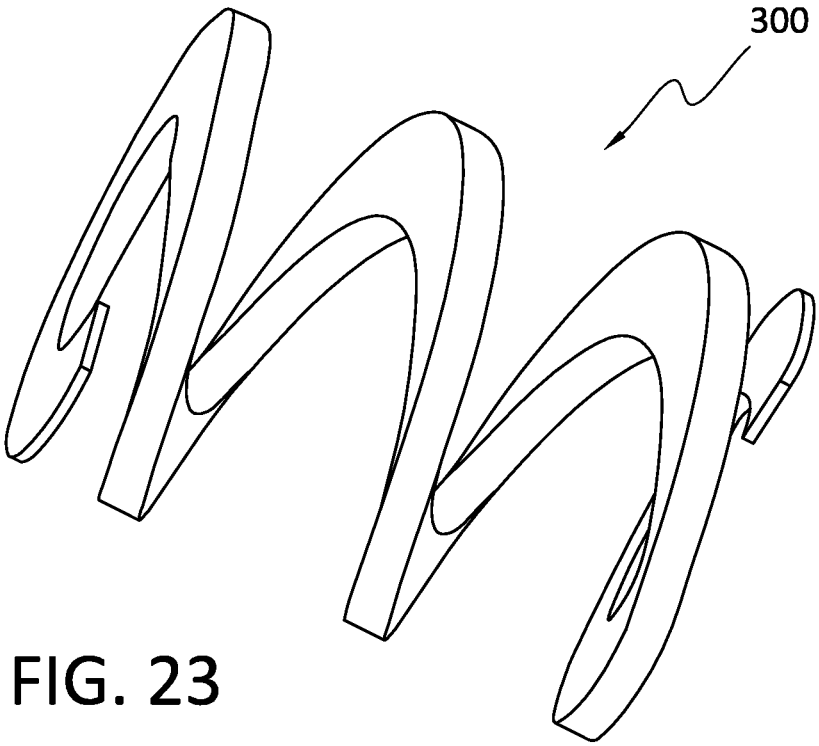

With reference now to FIG. 23, an example of a resistance element 300 is disclosed. In the illustrated example, the resistance element 300 takes the form of a flat helical spring, although the scope of the invention is not limited to that configuration and also embraces, for example, any helical spring, as well as other configurations such as a leaf spring for example. In general, the resistance element 300 is configured to releasably engage respective protrusions of the arms 202 and 204, such as the protrusions 202*b* and 204*b* for example.

The resistance element 300 may comprise, or consist of, a variety of different materials including, but not limited to, plastic, thermoplastics that include the family of synthetic polymers, based on aliphatic or semi-aromatic polyamides (such as the material sold under the mark NYLON®), polycarbonate, or glass fiber. Some example resistance element 300 compositions are disclosed in Appendix B hereto. As indicated in Appendix B, embodiments may include a plurality of resistance elements 300, each of which has a different respective spring constant 'k' such that a set of the resistance elements 300 can provide various different levels of resistance, depending upon the needs of the user.

The resistance elements 300 can include visible and/or tactile indicia indicating the level of resistance provided by the particular resistance element. For example, the resistance elements 300 can be color coded, and/or include bumps or other physical protrusions or perceptible features that correspond to the level of resistance provided by a particular resistance element. One example color scheme for a group of resistance elements is disclosed in Appendix B.

In addition to, or instead of, the resistance element 300, other embodiments of the invention can employ various other resistance mechanisms to impose resistance to movement of the arms 202/204 toward, and/or away from, each other. Some illustrative example of other resistance mechanisms are discussed below. It should be understood that the resistance element, and the other example resistance mechanisms disclosed herein, are example structural implementations of a means for resisting movement. Any other structures capable of implementing this function of resisting movement are likewise considered to be within the scope of this disclosure.

More particularly, the electronics 400 (also discussed in connection with FIG. 24) can include permanent magnets of opposing polarities that are disposed in a respective cavity, for example, of one or the other of the arms 202 and 204. Due to the opposing polarities, the magnets collectively tend to resist movement of the arms 202 and 204 toward each other. The magnets can be used interchangeably with stronger magnets, or weaker magnets, to change the level of resistance to movement of the arms 202 and 204. Alternatively, the magnets can be electromagnets that are powered by a power source such as a battery and whose polarity can be adjusted, for example, through use of an app, examples of which are disclosed herein, and/or by a user using controls (not shown) on one or both of the arms 202 and 204. Depending upon the embodiment, any one or more of springs, permanent magnets, and electromagnets, can be employed in an embodiment to provide resistance to the movement of the arms 202 and 204 relative to each other. It is noted that with reference to the electronics disclosed at page 13 of Appendix B, the following notations are employed: P+=VOLTAGE; C1=CAPACITOR; Q1B=DIODE; R2=RESISTANCE; and, U1=MICROCHIP.

Figure 24:
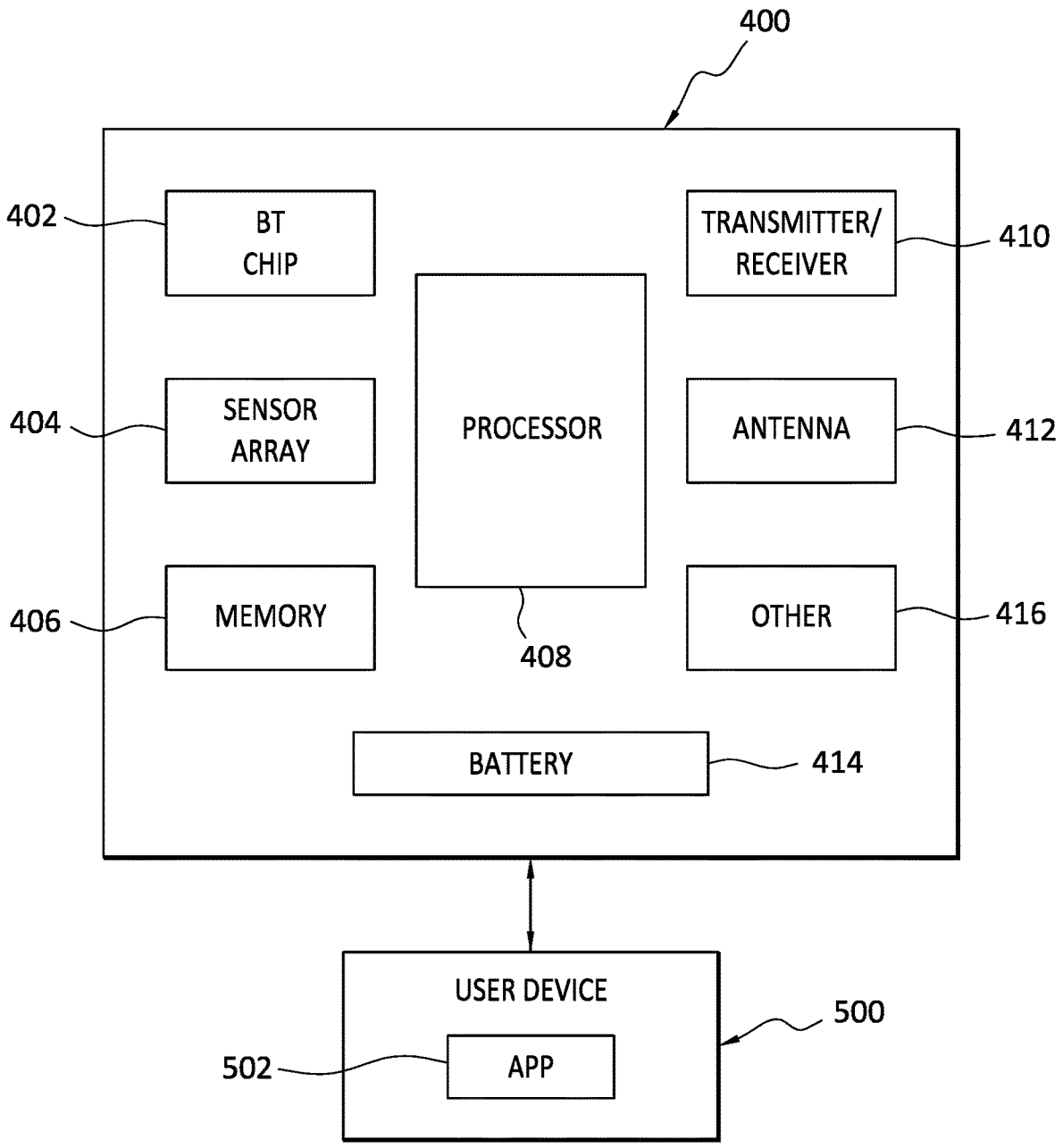

With reference finally to FIG. 24, a block diagram is shown that discloses details concerning example circuits and devices that may be included in one or more embodiments. In general, a muscle exercise device, one example of which is the muscle exercise device 200, can house various electronics 400, some or all of which are able to communicate with a user device 500, one example of which is a smartphone. As used herein, the term 'electronics' is intended to be broad in scope and is not limited to any particular system(s), component(s), or device(s). In the example of FIG. 24, the electronics 400 include a Bluetooth chip 402, sensor array 404, memory 406, processor(s) 408, a wireless transmitter/receiver 410, one or more antennas 412, a power source such as a battery 414, and any other circuitry, systems, and devices, collectively denoted at 416, that can be used to implement any one or more of the functions disclosed herein. Any element of the electronics 400 may communicate with any other element of the electronics 400 where such communications include, but are not limited to, transmission/receipt of data, transmission of power, and transmission/receipt of control signals.

As further indicated in FIG. 24, the electronics 400 of a muscle exercise device, such as the muscle exercise device 200 for example, may communicate with a user device 500, one example of which is a smartphone. Other examples of user devices are disclosed elsewhere herein. As shown in FIG. 24, and discussed earlier, the user device 500 may include an app 502. Communication between the app 502 and the electronics can include, in either direction, control signals, and data. Any processes or methods performed by any of the electronics 400, app 502, or other systems, components and devices disclosed herein, can take the form of executable instructions, executable by one or more processors, and carried on a non-transitory computer readable storage medium, examples of which are disclosed herein.

D. Example Computing Devices and Associated Media

The embodiments disclosed herein may include the use of a special purpose or general-purpose computer including various computer hardware or software modules, as discussed in greater detail below. A computer may include a processor and computer storage media carrying instructions that, when executed by the processor and/or caused to be executed by the processor, perform any one or more of the methods disclosed herein, or any part(s) of any method disclosed.

As indicated above, embodiments within the scope of the present invention also include computer storage media, which are physical media for carrying or having computer-executable instructions or data structures stored thereon. Such computer storage media can be any available physical media that can be accessed by a general purpose or special purpose computer.

By way of example, and not limitation, such computer storage media can comprise hardware storage such as solid state disk/device (SSD), RAM, ROM, EEPROM, CD-ROM, flash memory, phase-change memory ("PCM"), or other optical disk storage, magnetic disk storage or other magnetic storage devices, or any other hardware storage devices which can be used to store program code in the form of computer-executable instructions or data structures, which can be accessed and executed by a general-purpose or special-purpose computer system to implement the disclosed functionality of the invention. Combinations of the above should also be included within the scope of computer storage media. Such media are also examples of non-transitory storage media, and non-transitory storage media also embraces cloud-based storage systems and structures, although the scope of the invention is not limited to these examples of non-transitory storage media.

Computer-executable instructions comprise, for example, instructions and data which cause a general purpose computer, special purpose computer, or special purpose processing device to perform a certain function or group of functions.

Although the subject matter has been described in language specific to structural features and/or methodological acts, it is to be understood that the subject matter defined in the appended claims is not necessarily limited to the specific features or acts described above. Rather, the specific features and acts disclosed herein are disclosed as example forms of implementing the claims.

As used herein, the term 'module' or 'component' can refer to software objects or routines that execute on the computing system. The different components, modules, engines, and services described herein may be implemented as objects or processes that execute on the computing system, for example, as separate threads. While the system and methods described herein can be implemented in software, implementations in hardware or a combination of software and hardware are also possible and contemplated. In the present disclosure, a 'computing entity' may be any computing system as previously defined herein, or any module or combination of modules running on a computing system.

In at least some instances, a hardware processor is provided that is operable to carry out executable instructions for performing a method or process, such as the methods and processes disclosed herein. The hardware processor may or may not comprise an element of other hardware, such as the computing devices and systems disclosed herein.

In terms of computing environments, embodiments of the invention can be performed in client-server environments, whether network or local environments, or in any other suitable environment. Suitable operating environments for at least some embodiments of the invention include cloud computing environments where one or more of a client, server, or other machine may reside and operate in a cloud environment.

E. Appendices

Any and all appendices attached hereto, including Appendix A and Appendix B, form part of this disclosure, and are incorporated herein in their respective entireties at least by way of this reference.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A muscle exercise device, comprising:

a first arm;

a second arm rotatably connected to the first arm, and the second arm and the first arm are configured to cooperatively define a recess having a shape that changes as one of the first arm and the second arm moves toward, or away from, the other of the first arm and the second arm, and wherein the first arm and the second arm each define a respective cavity within which a respective electronic component is disposed;

a resistance element configured to reside in the recess and be compressed between the first arm and the second arm; and a wireless transmitter chip disposed in either the first arm or the second arm, wherein the wireless transmitter chip is responsive to communications from an app residing on a user device.

2. The muscle exercise device as recited in claim 1, wherein one or both of the first arm and the second arm include a first complementary structure configured to releasably engage a second complementary structure of the resistance element.

3. The muscle exercise device as recited in claim 1, wherein the resistance element is a helical spring that comprises plastic.

4. The muscle exercise device as recited in claim 1, wherein the first arm and the second arm each include a free end and a fixed end, and the respective fixed ends of the first arm and the second arm cooperatively define a hinge.

5. The muscle exercise device as recited in claim 1, wherein the first arm, the second arm, and the resistance element are configured to resist, or prevent, rotation of the resistance element when the resistance element is held between the first arm and the second arm.

6. The muscle exercise device as recited in claim 1, wherein the wireless transmitter comprises a near-field communication device.

7. The muscle exercise device as recited in claim 1, wherein the respective electronic components comprise a first element of a proximity sensor and a second element of the proximity sensor.

8. The muscle exercise device as recited in claim 1, wherein one of the first arm and the second arm is longer than the other of the first arm and the second arm.

9. The muscle exercise device as recited in claim 1, wherein one of the first arm and the second arm includes a bulbous portion at its terminal end.

10. The muscle exercise device as recited in claim 1, wherein the first arm and the second arm each include a respective lid disposed over one of the cavities, and the lid of the first arm and the lid of the second arm each include a respective protrusion configured and arranged to releasably engage the resistance element.

11. The muscle exercise device as recited in claim 1, further comprising a power source disposed in the cavity of the first arm or the cavity of the second arm, and the power source is connected to the wireless transmitter chip.

12. The muscle exercise device as recited in claim 1, wherein the resistance element includes indicia that provides user perceptible information concerning a resistance force associated with the resistance element.

13. The muscle exercise device as recited in claim 1, wherein the user device comprises a mobile phone.

14. A kit, comprising:

the muscle exercise device as recited in claim 1; and one or more additional resistance elements, each configured to exert a different respective resistance force.

15. A muscle exercise device, comprising:

a first arm;

a second arm hinged to the first arm;

means for resisting movement, wherein the means for resisting movement functions to resist movement of the first arm and second arm toward each other;

and the first arm defines a first cavity in which a first element of a proximity sensor is positioned, and the second arm defines a second cavity in which a second element of the proximity sensor is positioned, and a wireless communication chip is disposed in either the first cavity or the second cavity, and the wireless communication chip is configured to communicate with a remote user device.

16. The muscle exercise device as recited in claim 15, wherein the remote user device comprises a mobile phone.

17. The muscle exercise device as recited in claim 16, wherein the proximity sensor and the wireless communication chip are operable to interface, directly and/or indirectly, with an app on the mobile phone.

18. The muscle exercise device as recited in claim 15, wherein the proximity sensor is operable to detect a distance between the first arm and the second arm.

19. The muscle exercise device as recited in claim 15, further comprising electronics connected with the wireless communication chip, the electronics operable to cooperate with the wireless communication chip transmit data to, and receive data from, an app residing on the remote user device.

20. The muscle exercise device as recited in claim 15, wherein the first arm is longer than the second arm, and the first arm includes a bulbous portion proximate its terminal end.

21. The muscle exercise device as recited in claim 15, wherein a portion of one or both of the first arm and the second arm includes an overmold.

22. A kit, comprising:

the muscle exercise device as recited in claim 15;

one or more resistance elements, each of the resistance elements being associated with a different respective resistance force.

23. The muscle exercise device as recited in claim 15, wherein the means for resisting movement comprises any one or more of permanent magnets, electromagnets, and one or more springs.

* * * * *